US010324387B2

(12) United States Patent
Ishida et al.

(10) Patent No.: US 10,324,387 B2
(45) Date of Patent: Jun. 18, 2019

(54) ELECTROPHOTOGRAPHIC PHOTORECEPTOR AND ELECTROPHOTOGRAPHIC IMAGE FORMING DEVICE

(71) Applicant: Konica Minolta, Inc., Tokyo (JP)

(72) Inventors: Takeshi Ishida, Hachioji (JP); Seisuke Maeda, Hussa (JP); Kazuhiro Kuramochi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/948,032

(22) Filed: Apr. 9, 2018

(65) Prior Publication Data

US 2018/0307148 A1 Oct. 25, 2018

(30) Foreign Application Priority Data

Apr. 25, 2017 (JP) ..... 2017-085813

(51) Int. Cl.
*G03G 5/147* (2006.01)

(52) U.S. Cl.
CPC ..... *G03G 5/14726* (2013.01); *G03G 5/14704* (2013.01); *G03G 5/14734* (2013.01); *G03G 5/14791* (2013.01)

(58) Field of Classification Search
CPC ..... G03G 5/14726; G03G 5/14734; G03G 5/14704
See application file for complete search history.

(56) References Cited

U.S. PATENT DOCUMENTS 5,399,452 A * 3/1995 Takegawa ..... G03G 5/05 430/56
2005/0266328 A1* 12/2005 Yanagawa ..... G03G 5/0542 430/66
2014/0287351 A1* 9/2014 Takao ..... G03G 5/14704 430/56

FOREIGN PATENT DOCUMENTS

JP 05181299 A * 7/1993
JP 2009053727 A 3/2009
JP 2011069906 A * 4/2011
JP 2011128546 A 6/2011
JP 2011197443 A 10/2011
JP 2015099244 A 5/2015
JP 2015114453 A 6/2015
JP 2016164625 A 9/2016

OTHER PUBLICATIONS

English language machine translation of JP 2011-069906 (Apr. 2011).*
English language machine translation of JP 05-181299 (Jul. 1993).*

* cited by examiner

*Primary Examiner* — Christopher D Rodee
(74) *Attorney, Agent, or Firm* — Lucas & Mercanti, LLP

(57) ABSTRACT

Provided is an electrophotographic photoreceptor obtained by laminating a photosensitive layer and a surface protective layer in this order on a conductive support, wherein the surface protective layer contains conductive fine particles and crosslinkable organic fine particles, and either the conductive fine particles or the crosslinkable organic fine particles have been subjected to surface modification with a fluoroalkyl (meth)acrylate/(meth)acrylic acid copolymer.

12 Claims, 3 Drawing Sheets

ELECTROPHOTOGRAPHIC PHOTORECEPTOR AND ELECTROPHOTOGRAPHIC IMAGE FORMING DEVICE

The entire disclosure of Japanese patent Application No. 2017-085813, filed on Apr. 25, 2017, is incorporated herein by reference in its entirety.

BACKGROUND

Technological Field

The present invention relates to an electrophotographic photoreceptor and an electrophotographic image forming device. More specifically, the present invention relates to an electrophotographic photoreceptor or the like having good electrical characteristics and cleaning performance even if the supply amount of a lubricant is small.

Description of the Related Art

In recent years, a photoreceptor in an electrophotographic image forming device has required response to environmental pollution caused by generation of ozone or the like (hereinafter, also referred to as "environmental response"), and has also desired a long life in terms of cost. In order to improve the life of the photoreceptor, a technique is generally known in which conductive fine particles are added to a surface protective layer of the photoreceptor to improve mechanical strength and potential characteristics.

In addition, in recent years, a process of using a charging roller as a charging means has been used for environmental response.

However, in the process of using a charging roller, a lubricant supplied to a surface of a photoreceptor is decomposed by a discharge load thereof to form a water-soluble material, causing an image flow under a high temperature and high humidity environment disadvantageously.

Examples of a method for solving this problem include reducing or not using a lubricant supplied to a photoreceptor.

However, reducing or not using a lubricant causes cleaning failure, for example, a developer component such as a toner is not completely wiped off. As a result, a developer component is attached to a surface of a photoreceptor disadvantageously.

In this way, in a case where the supply amount of a lubricant to a photoreceptor is reduced in a process of using a charging roller, a technique of adding conductive fine particles and crosslinkable organic fine particles to a surface protective layer of the photoreceptor to improve cleaning performance is effective against the above problem.

For example, JP 2015-99244 A has reported a technique of adding conductive particles and crosslinkable organic fine particles to a surface protective layer of a photoreceptor in order to achieve both mechanical strength and cleaning performance of a photosensitive layer.

However, in this technique, when a coating dispersion for forming a surface protective layer is prepared, there is room for improvement in sensitivity and cleaning performance of a photoreceptor from a viewpoint of preventing aggregation of conductive fine particles with crosslinkable organic fine particles.

In addition, as an electrophotographic photoreceptor, for example, JP 2011-197443 A discloses a technique in which polytetrafluoroethylene (PTFE) particles are included in a surface protective layer containing a thermosetting compound, and JP 2011-128546 A discloses a technique in which composite particles of a fluorocarbon resin and inorganic particles are included in a surface protective layer containing a radically polymerizable compound.

In addition, JP 2009-53727 A discloses a technique of subjecting conductive particles included in a surface protective layer to a water repellent treatment using water and a fluorine-containing silane coupling agent.

In addition, JP 2016-164625 A discloses a technique in which metal oxide particles having a surface modified with a specific fluorine atom-containing surface modifier are included in a surface protective layer.

In addition, JP 2015-114453 A discloses a technique in which metal oxide particles and organic resin fine particles having a surface modified with a silane coupling agent are included in a surface protective layer.

However, even in techniques disclosed in JP 2015-99244 A, JP 2011-197443 A, JP 2011-128546 A, JP 2009-53727 A, JP 2016-164625 A, and JP 2015-114453 A, there is room for improvement in cleaning performance in a case where the supply amount of a lubricant is small.

SUMMARY

The present invention has been achieved in view of the above problems and circumstances, and an object of the present invention is to provide an electrophotographic photoreceptor and an electrophotographic image forming device having good electrical characteristics and cleaning performance even if the supply amount of a lubricant is small.

To achieve the abovementioned object, according to an aspect of the present invention, an electrophotographic photoreceptor reflecting one aspect of the present invention is obtained by laminating a photosensitive layer and a surface protective layer in this order on a conductive support, wherein the surface protective layer contains conductive fine particles and crosslinkable organic fine particles, and either the conductive fine particles or the crosslinkable organic fine particles have been subjected to surface modification with a fluoroalkyl (meth)acrylate/(meth)acrylic acid copolymer.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
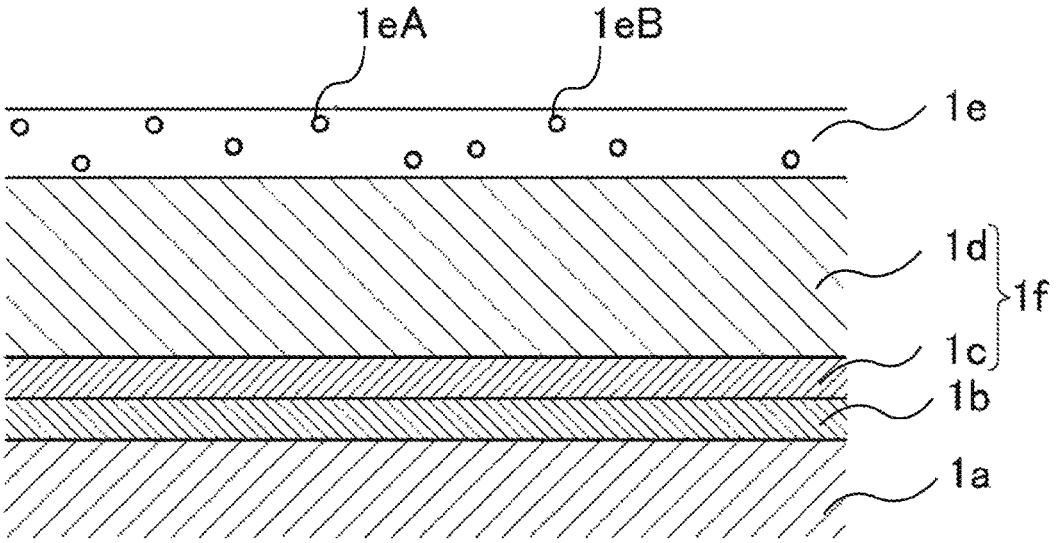
FIG. 1 is a schematic view illustrating an example of a layer configuration of a photoreceptor according to an embodiment of the present invention.

Hereinafter, one or more embodiments of the present invention will be described with reference to the drawings. However, the scope of the invention is not limited to the disclosed embodiments.

An electrophotographic photoreceptor of an embodiment of the present invention is obtained by laminating a photosensitive layer and a surface protective layer in this order on a conductive support, and is characterized in that the surface protective layer contains conductive fine particles and crosslinkable organic fine particles and that either the conductive fine particles or the crosslinkable organic fine particles have been subjected to surface modification with a fluoroalkyl (meth)acrylate/(meth)acrylic acid copolymer. This characteristic is a technical characteristic common or corresponding to the inventions according to claims. As a result, the present invention can obtain an effect capable of improving electrical characteristics and cleaning performance even if the supply amount of a lubricant is small.

In an aspect of the present invention, the fluoroalkyl (meth)acrylate/(meth)acrylic acid copolymer preferably has both a structural unit represented by the below general formula (1a) and a structural unit represented by the below general formula (1b). Dispersibility in a coating liquid for forming a surface protective layer can be thereby further improved. In addition, a friction coefficient of a surface of the surface protective layer can be further lowered.

In an aspect of the present invention, the crosslinkable organic fine particles preferably contain a compound having a melamine structure. As a result, lubricity is imparted to a surface of the photoreceptor, and better cleaning performance can be obtained.

In an aspect of the present invention, the conductive fine particles preferably have a number average primary particle diameter in a range of 10 to 500 nm. Aggregation can be thereby suppressed in a coating liquid for forming the surface protective layer, and higher dispersibility can be obtained.

In an aspect of the present invention, the conductive fine particles have been preferably subjected to surface modification with a compound having an acryloyl group or a methacryloyl group and the fluoroalkyl (meth)acrylate/(meth)acrylic acid copolymer. Dispersibility in a coating liquid for forming the surface protective layer can be thereby further improved. Furthermore, the friction coefficient and the hardness of a surface of the surface protective layer can be further improved.

In an aspect of the present invention, the conductive fine particles preferably contain any one of titanium oxide, tin oxide, and copper aluminate Conductivity of the surface protective layer is thereby further improved, and electrostatic characteristics of the photoreceptor can be further improved.

In an aspect of the present invention, the surface protective layer contains a binder resin, and the binder resin is preferably a curable resin obtained by polymerizing a crosslinkable polymerizable compound having an acryloyl group or a methacryloyl group. This further improves the hardness of the surface protective layer and can further reduce the scraping amount of the photoreceptor. As a result, the life of the photoreceptor can be further prolonged.

In an aspect of the present invention, the conductive fine particles are preferably composite fine particles obtained by attaching a conductive metal oxide to a surface of a core material. This makes it easier to manufacture conductive fine particles having a large particle diameter, and the effect of an embodiment of the present invention can be more effectively exhibited.

The electrophotographic photoreceptor of an embodiment of the present invention can be suitably included in an electrophotographic image forming device including a charging roller. As a result, electrical characteristics and cleaning performance can be improved even if the supply amount of a lubricant is small.

Hereinafter, the present invention, constituent elements thereof, and an embodiment and an aspect for performing the present invention will be described in detail. Incidentally, in the present application, "to" means inclusion of numerical values described before and after "to" as a lower limit value and an upper limit value.

<<Outline of Electrophotographic Photoreceptor>>

An electrophotographic photoreceptor (hereinafter, also referred to simply as a "photoreceptor") of an embodiment of the present invention is obtained by laminating a photosensitive layer and a surface protective layer in this order on a conductive support, and is characterized in that the surface protective layer contains conductive fine particles and crosslinkable organic fine particles and that either the conductive fine particles or the crosslinkable organic fine particles have been subjected to surface modification with a fluoroalkyl (meth)acrylate/(meth)acrylic acid copolymer (hereinafter, also referred to as a "specific fluorination surface modifier").

That is, in the present invention, both or at least one of the conductive fine particles and the crosslinkable organic fine particles is subjected to surface modification with a surface modifier containing a fluoroalkyl (meth)acrylate/(meth) acrylic acid copolymer, and is contained in the surface protective layer as an outermost surface layer of the photoreceptor.

[Photoreceptor]

The photoreceptor of an embodiment of the present invention is an organic photoreceptor obtained by laminating a photosensitive layer and a surface protective layer in this order on a conductive support.

The photosensitive layer of an embodiment of the present invention may have a multilayer structure including a charge generating layer and a charge transporting layer or may have a single layer structure including a charge generating material and a charge transporting material.

In the present invention, the organic photoreceptor refers to a photoreceptor in which at least one of a charge generating function and a charge transporting function indispensable for constituting the photoreceptor is exhibited by an organic compound, and includes all known organic photoreceptors such as a photoreceptor having an organic photosensitive layer including a known organic charge generating material or organic charge transporting material and a photoreceptor having an organic photosensitive layer in which a charge generating function and a charge transporting function are exhibited by a polymer complex.

As illustrated in FIG. 1, examples of the photoreceptor include a photoreceptor formed by laminating an intermediate layer 1*b*, a charge generating layer 1*c*, a charge transporting layer 1*d*, and a surface protective layer 1*e* in this order on a conductive support 1*a*. The charge generating layer 1*c* and the charge transporting layer 1*d* constitute an organic photosensitive layer 1*f* which is indispensable for constituting an organic photoreceptor.

[Surface Protective Layer 1*e*]

The surface protective layer constituting the photoreceptor according to an embodiment of the present invention contains conductive fine particles and crosslinkable organic fine particles.

The surface protective layer according to an embodiment of the present invention preferably contains a binder resin. Furthermore, the binder resin is preferably a curable resin obtained by polymerizing a crosslinkable polymerizable compound having an acryloyl group or a methacryloyl group. The acrylic group on surfaces of the conductive fine particles and the crosslinkable organic fine particles which have been subjected to surface modification with a specific fluorination surface modifier and the acrylic group of the polymerizable compound are thereby polymerized to further improve the hardness of the surface protective layer. Incidentally, if the hardness of the surface protective layer can be further improved, the scraping amount of the photoreceptor can be further reduced, and as a result, the life of the photoreceptor can be further prolonged.

The surface protective layer 1*e* constituting the photoreceptor of an embodiment of the present invention includes conductive fine particles and crosslinkable organic fine particles (hereinafter, also referred to as "conductive fine particles which have been subjected to specific fluorination surface modification" and "crosslinkable organic fine particles which have been subjected to specific fluorination surface modification" or collectively also referred to as "fine particles which have been subjected to specific fluorination surface modification") 1*e*A which have been subjected to surface modification with a surface modifier (hereinafter, also referred to as "specific fluorination surface modifier") containing a fluoroalkyl (meth)acrylate/(meth)acrylic acid copolymer (hereinafter, also referred to as "specific fluorination polymer") in a binder resin (hereinafter, also referred to as "binder resin for a surface protective layer").

Note that reference numeral 1*e*B in the surface protective layer 1*e* in FIG. 1 indicates conductive fine particles which have not been subjected to specific fluorination surface modification, such as untreated conductive fine particles described later, or crosslinkable organic fine particles which have not been subjected to specific fluorination surface modification, such as untreated crosslinkable organic fine particles.

The surface protective layer has a layer thickness preferably of 0.2 to 10 μm, more preferably of 0.5 to 6 μm.

The surface protective layer preferably contains conductive fine particles which have been subjected to specific fluorination surface modification or crosslinkable organic fine particles which have been subjected to specific fluorination surface modification in an amount of 50 to 200 parts by mass with respect to 100 parts by mass of the binder resin for a surface protective layer.

[Binder Resin for Surface Protective Layer]

The binder resin for a surface protective layer according to an embodiment of the present invention is not particularly limited, may be a thermoplastic resin or a curable resin such as a photocurable resin, but is particularly preferably a curable resin obtained by polymerizing a crosslinkable polymerizable compound having an acryloyl group or a methacryloyl group.

Specific examples of the binder resin for a surface protective layer include a polyvinyl butyral resin, an epoxy resin, a polyurethane resin, a phenol resin, a polyester resin, an alkyd resin, a polycarbonate resin, a silicone resin, an acrylic resin, and a melamine resin. In a case where a thermoplastic resin is used, a polycarbonate resin is preferably used. In a case where a photocurable resin is used, a crosslinkable polymerizable compound having an acryloyl group ($CH_2{=}CHCO{-}$) or a methacryloyl group ($CH_2{=}CCH_3CO{-}$), specifically a curable resin obtained by polymerizing an acrylic monomer having two or more acryloyl groups or methacryloyl groups or an oligomer thereof (hereinafter, also referred to as "radically polymerizable polyfunctional compound") by irradiation with an active ray such as an ultraviolet ray or an electron beam is preferably used because curing is possible with a small amount of light or a short time. Therefore, as the curable resin, an acrylic resin formed from an acrylic monomer or an oligomer thereof is preferably used.

The above compounds exemplified as the binder resin for a surface protective layer can be used singly or in combination of two or more kinds thereof.

[Crosslinkable Polymerizable Compound Having Acryloyl Group or Methacryloyl Group]

Examples of the crosslinkable polymerizable compound having an acryloyl group or a methacryloyl group include the following compounds.

[Chemical Formula 2]

M1

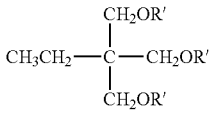

M2

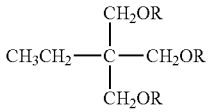

M3

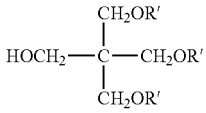

M4

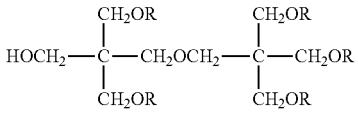

M5

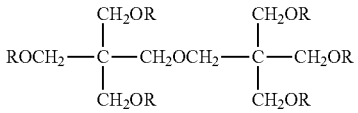

M6

M7

[Chemical Formula 3]

M8

M9

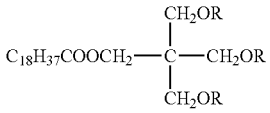

M10

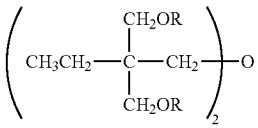

M11

M12

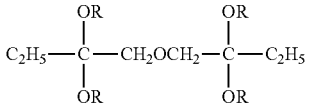

-continued

M13

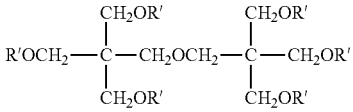

M14

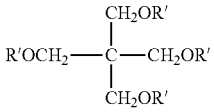

M15

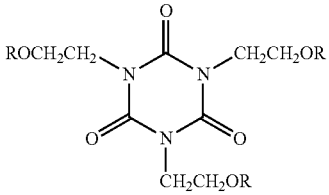

However, in the chemical formulas representing the above exemplified compounds M1 to M15, R represents an acryloyl group ($CH_2$═CHCO—), and R' represents a methacryloyl group ($CH_2$═$CCH_3$CO—).

<Conductive Fine Particles>

The conductive fine particles according to an embodiment of the present invention are preferably formed of a conductive metal oxide, and particularly preferably contain any one of titanium oxide, tin oxide, and copper aluminate because conductivity of the surface protective layer is further improved, and electrostatic characteristics of the photoreceptor can be further improved.

As described above, the conductive fine particles according to an embodiment of the present invention may be subjected to surface modification (specific fluorination surface modification) with the fluoroalkyl (meth)acrylate/(meth)acrylic acid copolymer. The conductive fine particles which have been subjected to specific fluorination surface modification are obtained by subjecting conductive fine particles which have not been subjected to surface modification as a raw material (hereinafter, also referred to as "untreated conductive fine particles", and also referred to simply as "conductive fine particles" in a case where it is unnecessary to particularly distinguish the untreated conductive fine particles from the conductive fine particles which have been subjected to specific fluorination surface modification) to surface modification with a specific fluorination surface modifier.

Note that the details of the surface modification with the fluoroalkyl (meth)acrylate/(meth)acrylic acid copolymer will be described later.

In addition, if the surface protective layer according to an embodiment of the present invention contains crosslinkable organic fine particles which have been subjected to surface modification with a fluoroalkyl (meth)acrylate/(meth)acrylic acid copolymer, the conductive fine particles may be the untreated conductive fine particles.

The conductive fine particles according to an embodiment of the present invention may be formed of a single conductive material or a plurality of materials such as composite fine particles having a core-shell structure obtained by forming an outer shell formed of a conductive material on a surface of a core material. Note that composite fine particles in which a conductive metal oxide is attached to a surface of a core material may be used as the conductive fine particles. In a case where the composite fine particles are used, the particle diameters of the conductive fine particles are large, and particles are more likely to aggregate. Therefore, the conductive fine particles are more preferably subjected to a fluorine treatment. Examples of the conductive metal oxide include the above-described compounds.

(Core Material)

Examples of the core material constituting the composite fine particles include an insulating material having a volume resistivity of about $10^{10}$ to $10^{16}$ Ω·cm. Specific examples thereof include barium sulfate, silica, and aluminum oxide, and at least one of these compounds is preferably used. Among these compounds, barium sulfate is preferable from a viewpoint of economy in addition to high dispersibility. In addition, the refractive index of silica is close to that of a curable resin as described later. Therefore, silica is preferable for forming a surface protective layer having good light transmittance.

(Content of Conductive Fine Particles)

The conductive fine particles are preferably contained in an amount of 50 to 200 parts by mass, more preferably 70 to 180 parts by mass with respect to 100 parts by mass of the binder resin for a surface protective layer.

By setting the content of the conductive fine particles to 50 parts by mass or more with respect to 100 parts by mass of the binder resin for a surface protective layer, desired electrical characteristics and a low friction property can be reliably obtained in the surface protective layer. Meanwhile, by setting the content of the conductive fine particles to 200 parts by mass or less with respect to 100 parts by mass of the binder resin for a surface protective layer, it is possible to prevent formation of a coating film from being inhibited when the surface protective layer is formed.

(Number Average Primary Particle Diameter of Conductive Fine Particles)

The conductive fine particles have a number average primary particle diameter preferably in a range of 10 to 500 nm, more preferably in a range of 10 to 300 mm. If the particle diameter is 10 nm or more, dispersibility in a coating liquid for forming the surface protective layer can be made appropriate from a viewpoint of a surface area. In addition, if the particle diameter is 500 nm or less, the dispersibility in the coating liquid can be made appropriate from a viewpoint of specific gravity. Meanwhile, if the particle diameters of the conductive fine particles are 10 nm or more, when resistance of the surface protective layer is set to a resistance that does not cause flowing of a latent image, the number of the conductive fine particles to be added can be reduced, and the scraping amount due to discharge of a charging roller can be reduced.

(Method for Measuring Number Average Primary Particle Diameter of Conductive Fine Particles)

The number average primary particle diameter of the conductive fine particles is measured as follows.

First, as a measurement sample, a photosensitive layer including a surface protective layer is cut out from a surface of a photoreceptor with a knife or the like and pasted on an arbitrary holder such that the cut surface faces upward.

Then, the measurement sample is observed with a transmission electron microscope, and calculation is performed using a photographic image which has been taken. A photograph is taken by setting the magnification of the microscope to 10000 times, and 100 sample fine particles (conductive fine particles) are randomly extracted from the photographic image for calculation. Specifically, horizontal direction Feret diameters of 100 sample fine particles are measured by image analysis processing, an average value thereof is calculated, and this value is taken as a number average primary particle diameter. Here, the horizontal direction Feret diameter refers to the length of a side parallel to an x axis of a circumscribed rectangle when an image of the sample fine particles is binarized. Note that the image analysis processing can be automatically performed, for example, by driving a program incorporated in a transmission electron microscope measurement apparatus. In the present invention, a transmission electron microscope "JEM-2000FX" (manufactured by JEOL Ltd.) is used for measuring particle diameters of fine particles.

[Surface Modification of Conductive Fine Particles Using Coupling Agent]

Conductive fine particles which have been subjected to specific fluorination surface modification or untreated conductive fine particles have been preferably subjected to surface modification with a compound having an acryloyl group ($CH_2{=}CHCO{-}$) or a methacryloyl group ($CH_2{=}CCH_3CO{-}$). Particularly, in the present invention, the conductive fine particles have been preferably subjected to surface modification with a compound having an acryloyl group or a methacryloyl group and a fluoroalkyl (meth) acrylate/(meth)acrylic acid copolymer. Dispersibility in a coating liquid for forming the surface protective layer can be thereby further improved. Furthermore, the friction coefficient and the hardness of a surface of the surface protective layer can be further improved.

Furthermore, the conductive fine particles which have been subjected to specific fluorination surface modification are preferably obtained by subjecting the conductive fine particles to surface modification with a silane coupling agent and then to surface modification with a specific fluorination surface modifier. Incidentally, by performing surface modification with a coupling agent prior to surface modification with a specific fluorination surface modifier, it is possible to avoid a risk that the fluorination surface modifier is not introduced onto surfaces of the conductive fine particles which have been treated with the coupling agent due to an oil repellent effect of the fluorination surface modifier. Therefore, this is preferable.

In a case where the binder resin for a surface protective layer is a curable resin formed from a crosslinkable polymerizable compound having an acryloyl group or a methacryloyl group, the conductive fine particles which have been subjected to surface modification with a coupling agent also react with the polymerizable compound. Therefore, a surface protective layer having sufficiently high strength can be formed.

Specifically, the surface modification of the conductive fine particles using a coupling agent can be performed by wet-pulverizing a slurry (a suspension of solid particles) containing untreated conductive fine particles and a coupling agent to refine the untreated conductive fine particles and at the same time to perform a coupling treatment of the particles, then removing a solvent, and powdering the particles.

The slurry is preferably obtained by mixing 0.1 to 100 parts by mass of the coupling agent and 50 to 5000 parts by mass of the solvent with respect to 100 parts by mass of the untreated conductive fine particles.

Examples of a device used for wet-pulverizing a slurry include a wet media dispersion type device. As the wet media dispersion type device, a known device can be used, and examples thereof include a wet media dispersion type device described in paragraphs 0037 to 0039 of JP 2016-184059 A.

[Coupling Agent]

Examples of the coupling agent that can be used in the present invention include a silane coupling agent and a titanium coupling agent having an acryloyl group or a methacryloyl group, as described above.

Examples of the silane coupling agent having an acryloyl group or a methacryloyl group include known compounds as described below.

S1: $CH_2{=}CHCOO(CH_2)_2Si(CH_3)(OCH_3)_2$
S2: $CH_2{=}CHCOO(CH_2)_2Si(OCH_3)_3$
S3: $CH_2{=}CHCOO(CH_2)_2Si(OC_2H_5)(OCH_3)_2$
S4: $CH_2{-}CHCOO(CH_2)_3Si(OCH_3)_3$
S5: $CH_2{=}CHCOO(CH_2)_2Si(CH_3)Cl_2$
S6: $CH_2{=}CHCOO(CH_2)_2SiCl_3$
S7: $CH_2{=}CHCOO(CH_2)_3Si(CH_3)Cl_2$
S8: $CH_2{-}CHCOO(CH_2)_3SiCl_3$
S9: $CH_2{=}C(CH_3)COO(CH_2)_2Si(CH_3)(OCH_3)_2$
S10: $CH_2{=}C(CH_3)COO(CH_2)_2Si(OCH_3)_3$
S11: $CH_2{=}C(CH_3)COO(CH_2)_3Si(CH_3)(OCH_3)_2$
S12: $CH_2{=}C(CH_3)COO(CH_2)_3Si(OCH_3)_3$
S13: $CH_2{=}C(CH_3)COO(CH_2)_2Si(CH_3)Cl_2$
S14: $CH_2{=}C(CH_3)COO(CH_2)_2SiCl_3$
S15: $CH_2{=}C(CH_3)COO(CH_2)_3Si(CH_3)Cl_2$
S16: $CH_2{=}C(CH_3)COO(CH_2)_3SiCl_3$
S17: $CH_2{=}CHCOOSi(OCH_3)_3$
S18: $CH_2{=}CHCOOSi(OC_2H_5)_3$
S19: $CH_2{=}C(CH_3)COOSi(OCH_3)_3$
S20: $CH_2{=}C(CH_3)COOSi(OC_2H_5)_3$
S21: $CH_2{=}C(CH_3)COO(CH_2)_3Si(OC_2H_5)_3$
S22: $CH_2{=}CHCOO(CH_2)_2Si(CH_3)_2(OCH_3)$
S23: $CH_2{=}CHCOO(CH_2)_2Si(CH_3)(OCOCH_3)_2$
S24: $CH_2{=}CHCOO(CH_2)_2Si(CH_3)(ONHCH_3)_2$
S25: $CH_2{=}CHCOO(CH_2)_2Si(CH_3)(OC_6H_5)_2$
S26: $CH_2{=}CHCOO(CH_2)_2Si(C_{10}H_{21})(OCH_3)_2$
S27: $CH_2{=}CHCOO(CH_2)_2Si(CH_2C_6H_5)(OCH_3)_2$

Examples of the titanium coupling agent having an acryloyl group or a methacryloyl group include titanium methacrylate triisopropoxide.

These coupling agents can be used singly or in admixture of two or more kinds thereof.

The use amount of the coupling agent is preferably 1 to 15 parts by mass, and more preferably 3 to 10 parts by mass with respect to 100 parts by mass of the untreated conductive fine particles.

It can be confirmed by differential thermal/thermogravimetric (TG/DTA) measurement that the conductive fine particles have been subjected to surface modification with a coupling agent.

<Crosslinkable Organic Fine Particles>

The crosslinkable organic fine particles according to an embodiment of the present invention (hereinafter, also referred to simply as "organic fine particles") preferably contain a compound having a melamine structure because lubricity is imparted to a surface of the photoreceptor and better cleaning performance can be obtained.

As described above, the crosslinkable organic fine particles according to an embodiment of the present invention may be subjected to surface modification (specific fluorination surface modification) with the fluoroalkyl (meth)acrylate/(meth)acrylic acid copolymer. The crosslinkable organic fine particles which have been subjected to specific fluorination surface modification are obtained by subjecting crosslinkable organic fine particles which have not been subjected to surface modification as a raw material (hereinafter, also referred to as "untreated crosslinkable organic fine particles", and also referred to simply as "crosslinkable organic fine particles" in a case where it is unnecessary to particularly distinguish the untreated crosslinkable organic fine particles from the crosslinkable organic fine particles which have been subjected to specific fluorination surface modification) to surface modification with a specific fluorination surface modifier.

Incidentally, if the surface protective layer according to an embodiment of the present invention contains conductive fine particles which have been subjected to surface modification with a fluoroalkyl (meth)acrylate/(meth)acrylic acid copolymer, the crosslinkable organic fine particles may be the untreated crosslinkable organic fine particles.

(Compound Having Melamine Structure)

Specific examples of the compound having a melamine structure include a polycondensate of melamine and formaldehyde, and a melamine resin such as a copolycondensate of melamine, benzoguanamine, and formaldehyde. As the organic fine particles, for example, composite particles formed of a compound having a melamine structure and a metal oxide may be used. A commercially available product may be used. For example, "Epostar S" (manufactured by Nippon Shokubai Co., Ltd.) having a melamine structure can be used as the crosslinkable organic fine particles.

The compound having a melamine structure is a low friction material. Therefore, the organic fine particles containing the compound impart lubricity to a surface of the photoreceptor, and good cleaning performance can be obtained. In addition, the compound having a melamine structure has high compatibility with a curable resin. Therefore, dispersibility of the organic fine particles in the curable resin can be increased, and furthermore, desorption of the organic fine particles from the surface protective layer can be reduced. Therefore, by containing a compound having a melamine structure, the organic fine particles are retained in a state existing on a surface of the photoreceptor, and good cleaning performance can be obtained over a long period of time.

(Particle Diameters of Organic Fine Particles)

The organic fine particles have a number average primary particle diameter preferably of 100 to 1500 nm, more preferably of 200 to 1000 nm.

By setting the number average primary particle diameter of the organic fine particles in the above range, good cleaning performance can be obtained while light transmittance of the surface protective layer is secured.

By setting the number average primary particle diameter of the organic fine particles to 100 nm or more, aggregation of the organic fine particles in a coating liquid during formation of the surface protective layer is suppressed, and as a result, a photoreceptor having good cleaning performance can be obtained. Meanwhile, if the number average primary particle diameter of the organic fine particles is 1500 nm or less, it is possible to avoid lowering of light transmittance, and furthermore to avoid aggregation and sedimentation in a coating liquid during formation of the surface protective layer. It is thereby possible to secure light transmittance of the surface protective layer, and furthermore to obtain good cleaning performance and electrical characteristics. Note that it can be found whether aggregation or sedimentation associated therewith has occurred by measuring a surface potential of a completed photoreceptor. In the present application, if a surface potential measured under conditions described in Example is less than 80 V, it is judged that no aggregation or sedimentation has occurred.

In the present invention, a method for measuring the number average primary particle diameter of the organic fine particles only needs to use organic fine particles as the sample fine particles in the method for measuring the number average primary particle diameter of the conductive fine particles.

The organic fine particles preferably have a refractive index of 1.4 to 1.8, for example, from a viewpoint of securing light transmittance of the surface protective layer. For example, the melamine resin has a refractive index of about 1.6 as a general literature value.

The organic fine particles are contained in an amount preferably of 5 to 75 parts by mass, more preferably of 10 to 50 parts by mass with respect to 100 parts by mass of the curable resin.

By setting the content of the organic fine particles in the above range, light transmittance and cleaning performance can be secured.

[Specific Fluorination Surface Modification]

As described above, in the present invention, either the conductive fine particles or the crosslinkable organic fine particles have been subjected to surface modification with a fluoroalkyl (meth)acrylate/(meth)acrylic acid copolymer as a specific fluorination surface modifier.

<Surface Modification Using Specific Fluorination Surface Modifier>

Specifically, the surface modification of the conductive fine particles or the crosslinkable organic fine particles using a specific fluorination surface modifier can be performed by dispersing fine particles to be surface-modified in an alcohol-based dispersion medium such as methanol or 2-butanol, adding a specific fluorination surface modifier thereto for mixing, and volatilizing the dispersion medium or volatilizing the dispersion medium and then performing a heat treatment.

(Fluoroalkyl (meth)acrylate/(meth)acrylic acid Copolymer)

For example, the fluoroalkyl (meth)acrylate/(meth)acrylic acid copolymer according to an embodiment of the present invention does not require a reaction with a silanol group at the time of surface modification unlike a general silane coupling agent or the like.

The specific fluorination polymer constituting the specific fluorination surface modifier preferably has both a structural unit represented by the following general formula (1a) and a structural unit represented by the above general formula (1b) because dispersibility in a coating liquid for forming the surface protective layer can be further improved and a friction coefficient of a surface of the surface protective layer can be further lowered.

[Chemical Formula 4]

General Formula (1a)

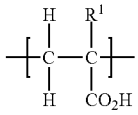

General Formula (1b)

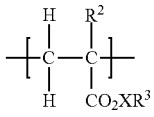

[In the formula, $R^1$ represents a hydrogen atom or a methyl group. $R^2$ represents a linear or branched alkyl group having 1 to 4 carbon atoms. X represents an alkylene group having 1 to 4 carbon atoms. $R^3$ represents a perfluoroalkyl group having 1 to 5 carbon atoms.]

Note that the specific fluorination polymer preferably has a molecular weight of 5,000 to 30,000 in terms of number average molecular weight.

By setting the molecular weight of the specific fluorination polymer in the above range, a low friction property and powder resistance of the conductive fine particles can be reliably adjusted in a desired range.

Examples of the specific fluorination polymer include a 2,2,3,3,4,4,4-heptafluorobutyl methacrylate/acrylic acid copolymer, a 2,2,3,3-tetrafluoropropyl methacrylate/methacrylic acid copolymer, and a 2,2,3,3,4,4,5,5,5-nonafluoropentyl methacrylate/acrylic acid copolymer.

These polymers can be used singly or in admixture of two or more kinds thereof.

The use amount of the specific fluorination surface modifier is preferably 0.5 to 20 parts by mass, and more preferably 1 to 10 parts by mass with respect to 100 parts by mass of the conductive fine particles or the organic fine particles.

It can be confirmed by differential thermal/thermogravimetric (TG/DTA) measurement that the conductive fine particles or the organic fine particles have been subjected to surface modification with a fluorination surface modifier.

[Formation of Surface Protective Layer]

The surface protective layer can be formed by a known method, and specifically, for example, can be manufactured by applying a coating liquid prepared by adding a crosslinkable polymerizable compound having an acryloyl group or a methacryloyl group, conductive fine particles, and crosslinkable organic fine particles (either the conductive fine particles or the crosslinkable organic fine particles have been subjected to specific fluorination surface modification), optionally adding a known resin, a polymerization initiator, an antioxidant, and the like to a solvent and dissolving or dispersing these onto a surface of a charge transporting layer by a known method to form a coating film, and curing the coating film.

[Polymerization Initiator]

The polymerization initiator that can be contained in the surface protective layer is a radical polymerization initiator that initiates a polymerization reaction of a crosslinkable polymerizable compound having an acryloyl group or a methacryloyl group, and examples thereof include a thermal polymerization initiator and a photopolymerization initiator.

Examples of a method for polymerizing a crosslinkable polymerizable compound having an acryloyl group or a methacryloyl group include a method utilizing an electron beam cleavage reaction and a method utilizing light or heat in the presence of a radical polymerization initiator.

Examples of the thermal polymerization initiator include: an azo compound such as 2,2'-azobisisobutyronitrile, 2,2'-azobis(2,4-dimethylazobisvaleronitrile), or 2,2'-azobis(2-methylbutyronitrile); and a peroxide such as benzoyl peroxide (BPO), di-tert-butyl hydroperoxide, tert-butyl hydroperoxide, chlorobenzoyl peroxide, dichlorobenzoyl peroxide, bromomethylbenzoyl peroxide, or lauroyl peroxide.

Examples of the photopolymerization initiator include: an acetophenone-based or ketal-based photopolymerization initiator such as diethoxyacetophenone, 2,2-dimethoxy-1,2-diphenylethan-1-one, 1-hydroxy-cyclohexyl-phenyl-ketone, 4-(2-hydroxyethoxy) phenyl-(2-hydroxy-2-propyl) ketone, 2-benzyl-2-dimethylamino-1-(4-morpholinophenyl) butanone-1 ("Irgacure 369" (manufactured by BASF Japan)), 2-hydroxy-2-methyl-1-phenylpropan-1-one, 2-methyl-2-morpholino (4-methylthiophenyl) propan-1-one, or 1-phenyl-1,2-propanedione-2-(o-ethoxycarbonyl) oxime; a benzoin ether-based photopolymerization initiator such as benzoin, benzoin methyl ether, benzoin ethyl ether, benzoin isobutyl ether, or benzoin isopropyl ether; a benzophenone-based photopolymerization initiator such as benzophenone, 4-hydroxybenzophenone, methyl o-benzoylbenzoate, 2-benzoyl naphthalene, 4-benzoyl biphenyl, 4-benzoyl phenyl ether, acrylated benzophenone, or 1,4-benzoyl benzene; and a thioxanthone-based photopolymerization initiators such as 2-isopropylthioxanthone, 2-chlorothioxanthone, 2,4-dimethylthioxanthone, 2,4-diethylthioxanthone, or 2,4-dichlorothioxanthone.

Examples of other photopolymerization initiators include ethylanthraquinone, 2,4,6-trimethylbenzoyl diphenylphosphine oxide, 2,4,6-trimethylbenzoylphenyl ethoxyphosphine oxide, bis(2,4,6-trimethylbenzoyl) phenylphosphine oxide ("Irgacure 819" (manufactured by BASF Japan), bis(2,4-dimethoxybenzoyl)-2,4,4-trimethylpentylphosphine oxide, methylphenylglyoxy ester, 9,10-phenanthrene, an acridine-based compound, a triazine-based compound, and an imidazole-based compound. In addition, a compound having a photopolymerization accelerating effect can be used singly or in combination with the above photopolymerization initiators. Examples of the compound having a photopolymerization accelerating effect include triethanolamine, methyldiethanolamine, ethyl 4-dimethylaminobenzoate, isoamyl 4-dimethylaminobenzoate, (2-dimethylamino) ethyl benzoate, and 4,4'-dimethylaminobenzophenone.

As the polymerization initiator, a photopolymerization initiator is preferably used, an alkylphenone-based compound or a phosphine oxide-based compound is more preferably used, and a photopolymerization initiator having an α-hydroxyacetophenone structure or an acylphosphine oxide structure is still more preferably used.

These polymerization initiators may be used singly or in admixture of two or more kinds thereof.

A use ratio of a polymerization initiator is 0.1 to 40 parts by mass, and preferably 0.5 to 20 parts by mass with respect to 100 parts by mass of a crosslinkable polymerizable compound having an acryloyl group or a methacryloyl group.

[Solvent]

Examples of a solvent used for forming the surface protective layer include methanol, ethanol, 1-propanol, 2-propanol, 1-butanol, 2-butanol, 2-methyl-2-propanol, benzyl alcohol, methyl isopropyl ketone, methyl isobutyl ketone, methyl ethyl ketone, cyclohexane, toluene, xylene, dichloromethane, ethyl acetate, butyl acetate, 2-methoxyethanol, 2-ethoxyethanol, tetrahydrofuran, 1-dioxane, 1,3-dioxolane, pyridine, and diethylamine, but are not limited thereto.

These solvents can be used singly or in admixture of two or more kinds thereof.

Examples of a means for dispersing conductive fine particles and organic fine particles in a coating liquid include an ultrasonic dispersing machine, a ball mill, a sand mill, and a homomixer, but are not limited thereto.

Examples of a method for applying a coating liquid include a known method such as a dip coating method, a spray coating method, a spinner coating method, a bead coating method, a blade coating method, a beam coating method, a slide hopper method, or a method using a circular slide hopper applicator. Application is particularly preferably performed by the method using a circular slide hopper applicator because application is possible without deteriorating dispersibility of conductive fine particles and organic fine particles in a coating liquid.

In the curing treatment, preferably, a coating film is irradiated with an active ray to generate radicals for polymerization, and a crosslinking bond is formed between molecules and within a molecule by a crosslinking reaction to perform curing, thereby forming a binder resin for a surface protective layer. As the active ray, light such as an ultraviolet ray or visible light or an electron beam is preferably used, and an ultraviolet ray is particularly preferably used from a viewpoint of ease of use.

Examples of a light source of an ultraviolet ray include a low-pressure mercury lamp, a medium-pressure mercury lamp, a high-pressure mercury lamp, an extra high-pressure mercury lamp, a carbon arc lamp, a metal halide lamp, a xenon lamp, a flash (pulse) xenon, and an ultraviolet LED. Irradiation conditions vary depending on a lamp, but an irradiation dose of an active ray is usually 1 to 20 $mJ/cm^2$, and preferably 5 to 15 $mJ/cm^2$. An output voltage of a light source is preferably 0.1 to 5 kW, and particularly preferably 0.5 to 3 kW.

As an electron beam source, for example, a curtain beam type electron beam irradiation device can be preferably used. An accelerating voltage upon irradiation with an electron beam is preferably 100 to 300 kV.

An absorption dose is preferably 0.005 Gy to 100 kGy (0.5 to 10 Mrad).

Irradiation time of an active ray may be any time as long as a required irradiation dose of the active ray can be obtained. Specifically, the irradiation time is preferably 0.1 seconds to 10 minutes, and more preferably 1 second to 5 minutes from a viewpoint of curing efficiency or working efficiency.

A coating film may be dried before and after irradiation with an active ray and during the irradiation with the active ray. Timing of performing the drying treatment can be appropriately selected in combination with irradiation conditions of an active ray. Drying conditions for the surface protective layer can be appropriately selected depending on the kind of solvent used for a coating liquid, the thickness of the surface protective layer, and the like. A drying temperature is preferably room temperature to 180° C., and particularly preferably 80 to 140° C. Drying time is preferably 1 to 200 minutes, and particularly preferably 5 to 100 minutes. By drying a coating film under such drying conditions, the amount of solvent contained in the surface protective layer can be controlled in a range of 20 ppm to 75 ppm.

Hereinafter, the configuration of the photoreceptor other than the surface protective layer will be described.

[Conductive Support 1*a*]

A conductive support only needs to have conductivity, and examples thereof include a product obtained by molding a metal such as aluminum, copper, chromium, nickel, zinc, or stainless steel into a drum or sheet shape, a product obtained by laminating a metal foil such as aluminum or copper on a plastic film, a product obtained by vapor-depositing aluminum, indium oxide, tin oxide, or the like on a plastic film, and a metal, a plastic film, paper, and the like having a conductive layer disposed by applying a conductive material alone or together with a binder resin.

[Intermediate Layer 1*b*]

An intermediate layer imparts a barrier function and an adhesive function between the conductive support and the photosensitive layer. Such an intermediate layer is preferably disposed from a viewpoint of preventing various failures.

Such an intermediate layer contains, for example, a binder resin (hereinafter, also referred to as "binder resin for an intermediate layer") and, if necessary, conductive particles or metal oxide particles.

Examples of the binder resin for an intermediate layer include casein, polyvinyl alcohol, nitrocellulose, an ethylene-acrylic acid copolymer, a polyamide resin, a polyurethane resin, and gelatin. Among these resins, an alcohol-soluble polyamide resin is preferable.

The intermediate layer can contain various conductive particles and metal oxide particles in order to adjust resistance. Examples thereof include various metal oxide particles such as alumina, zinc oxide, titanium oxide, tin oxide, antimony oxide, indium oxide, or bismuth oxide. Ultrafine particles such as indium oxide doped with tin or tin oxide and zirconium oxide doped with antimony can be used.

Such metal oxide particles have a number average primary particle diameter preferably of 0.3 μm or less, more preferably of 0.1 μm or less.

The metal oxide particles may be used singly or in admixture of two or more kinds thereof. In a case where two or more kinds are mixed, the metal oxide particles may be in a form of solid solution or fusion.

The content of the conductive particles or the metal oxide particles is preferably 20 to 400 parts by mass, and more preferably 50 to 200 parts by mass with respect to 100 parts by mass of the binder resin for an intermediate layer.

The intermediate layer as described above can be formed, for example, by dissolving a binder resin for an intermediate layer in a known solvent, dispersing conductive particles or metal oxide particles therein if necessary to prepare a coating liquid for forming an intermediate layer, applying the coating liquid for forming an intermediate layer onto a surface of a conductive support to form a coating film, and drying the coating film.

The solvent used for forming an intermediate layer is not particularly limited, and examples thereof include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichlorethylene, tetrachloroethane, tetrahydrofuran, dioxolane, dioxane, methanol, ethanol, butanol, isopropanol, ethyl acetate, butyl acetate, dimethyl sulfoxide, and methyl cellosolve. Among these solvents, toluene, tetrahydrofuran, dioxolane, and the like are preferably used. These solvents can be used singly or as a mixed solvent of two or more kinds thereof.

Examples of a means for dispersing conductive particles or metal oxide particles include an ultrasonic dispersing machine, a ball mill, a sand grinder, and a homomixer.

Examples of a method for applying a coating liquid for forming an intermediate layer is not particularly limited, but examples thereof include a dip coating method and a spray coating method.

As a method for drying a coating film, a known drying method can be appropriately selected according to the kind of solvent and the thickness of an intermediate layer to be formed, and a coating film is particularly preferably dried by heat.

The intermediate layer has a thickness preferably of 0.1 to 15 μm, more preferably of 0.3 to 10 μm.

[Charge Generating Layer 1*c*]

The charge generating layer contains a charge generating material and a binder resin (hereinafter, also referred to as "binder resin for a charge generating layer").

Examples of the charge generating material include: an azo raw material such as Sudan Red or Diane Blue; a quinone pigment such as pyrenequinone or anthanthrone; a quinocyanine pigment; a perylene pigment; an indigo pigment such as indigo or thioindigo; a polycyclic quinone pigment such as pyranthrone or diphthaloyl pyrene; and a phthalocyanine pigment, but are not limited thereto. Among these materials, a polycyclic quinone pigment and a titanyl phthalocyanine pigment are preferable. These charge generating materials may be used singly or in admixture of two or more kinds thereof.

As the binder resin for a charge generating layer, a known resin can be used, and examples thereof include a polystyrene resin, a polyethylene resin, a polypropylene resin, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin, a copolymer resin containing two or more of these resins (for example, a vinyl chloride-vinyl acetate copolymer resin or a vinyl chloride-vinyl acetate-maleic anhydride copolymer resin), and a poly-vinyl carbazole resin, but are not limited thereto. Among these resins, a polyvinyl butyral resin is preferable.

The content of the charge generating material in the charge generating layer is preferably 1 to 600 parts by mass, and more preferably 50 to 500 parts by mass with respect to 100 parts by mass of the binder resin for a charge generating layer.

As a mixing ratio between the binder resin for a charge generating layer and the charge generating material, the content of the charge generating material is preferably 20 to 600 parts by mass, and more preferably 50 to 500 parts by mass with respect to 100 parts by mass of the binder resin for a charge generating layer. By setting the mixing ratio between the binder resin for a charge generating layer and the charge generating material in the above range, a coating liquid for forming a charge generating layer described later can obtain high dispersion stability, electric resistance in a formed photoreceptor can be suppressed to a low level, and an increase in residual potential due to repeated use can be extremely suppressed.

The charge generating layer as described above can be formed, for example, by adding a charge generating material to a binder resin for a charge generating layer dissolved in a known solvent and dispersing the charge generating material therein to prepare a coating liquid for forming a charge generating layer, applying the coating liquid for forming a charge generating layer onto a surface of an intermediate layer to form a coating film, and drying this coating film.

The solvent used for forming the charge generating layer may be any solvent capable of dissolving the binder resin for the charge generating layer, and examples thereof include: a ketone-based solvent such as methyl ethyl ketone, methyl isopropyl ketone, methyl isobutyl ketone, cyclohexanone, or acetophenone; an ether-based solvent such as tetrahydrofuran, dioxolane, or diglyme; an alcohol-based solvent such as methyl cellosolve, ethyl cellosolve, or butanol; an ester-based solvent thereof such as ethyl acetate or t-butyl acetate, an aromatic solvent such as toluene or chlorobenzene; and a halogen-based solvent such as dichloroethane or trichloroethane, but are not limited thereto. These solvents can be used singly or in admixture of two or more kinds thereof.

Examples of a means for dispersing the charge generating material include the same method as the means for dispersing the conductive particles or the metal oxide particles in the coating liquid for forming the intermediate layer.

Examples of a method for applying a coating liquid for forming a charge generating layer include the same method as those exemplified as the method for applying a coating liquid for forming an intermediate layer.

The layer thickness of the charge generating layer varies depending on characteristics of the charge generating material, characteristics of the binder resin for the charge generating layer, the content thereof, and the like, but is preferably 0.1 to 2 μm, and more preferably 0.15 to 1.5 μm.

[Charge Transporting Layer 1*d*]

The charge transporting layer contains a charge transporting material and a binder resin (hereinafter, also referred to as "binder resin for a charge transporting layer").

Examples of a charge transporting material of the charge transporting layer include a triphenylamine derivative, a hydrazone compound, a styryl compound, a benzidine compound, and a butadiene compound.

As the binder resin for a charge transporting layer, a known resin can be used, and examples thereof include a polycarbonate resin, a polyacrylate resin, a polyester resin, a polystyrene resin, a styrene-acrylonitrile copolymer resin, a polymethacrylate resin, and a styrene-methacrylate copolymer resin, but a polycarbonate resin is preferable. Furthermore, for example, polycarbonate resins of a BPA (bisphenol A) type, a BPZ (bisphenol Z) type, a dimethyl BPA type, and a BPA-dimethyl BPA copolymer type are preferable from a viewpoint of crack resistance, abrasion resistance, and charging characteristics.

The content ratio of the charge transporting material in the charge transporting layer is preferably 10 to 500 parts by mass, and more preferably from 20 to 250 parts by mass with respect to 100 parts by mass of the binder resin for a charge transporting layer.

The charge transporting layer may include an antioxidant, an electron conducting agent, a stabilizer, a silicone oil, or the like. An antioxidant disclosed in JP 2000-305291 A is preferable, and an electronic conducting agent disclosed in JP 50-137543 A, JP 58-76483 A, and the like are preferable.

The layer thickness of the charge transporting layer varies depending on characteristics of the charge transporting material, characteristics of the binder resin for the charge transporting layer, the content thereof, and the like, but is preferably 5 to 40 μm, and more preferably 10 to 30 μm.

The charge transporting layer as described above can be formed, for example, by adding a charge transporting material (CTM) to a binder resin for a charge transporting layer dissolved in a known solvent and dispersing the charge transporting material therein to prepare a coating liquid for forming the charge transporting layer, applying the coating liquid for forming the charge transporting layer onto a surface of a charge generating layer to form a coating film, and drying this coating film.

Examples of the solvent used in the formation of the charge transporting layer include the same solvents as those used for forming the charge generating layer.

In addition, examples of a method for applying a coating liquid for forming the charge transporting layer include the same method as those exemplified as the method for applying a coating liquid for forming the charge generating layer.

[Electrophotographic Image Forming Device]

The electrophotographic photoreceptor of an embodiment of the present invention can be adopted for an electrophotographic image forming device having a general electrophotographic process, and is particularly useful in a case where the amount of a lubricant supplied to the photoreceptor is small, for example, in a case where a lubricant is supplied from a developer to the photoreceptor using a process having a charging roller, particularly a process having an AC application type charging roller.

Examples of the above electrophotographic image forming device having a general electrophotographic process include a device including a photoreceptor, a charging unit for charging a surface of the photoreceptor, an exposing unit for forming an electrostatic latent image on the surface of the photoreceptor, a developing unit for developing the electrostatic latent image with a toner to form a toner image, a transfer unit for transferring the toner image onto a transfer material, a fixing unit for fixing the toner image transferred onto the transfer material, and a cleaning unit for removing a residual toner on the photoreceptor.

Figure 2:
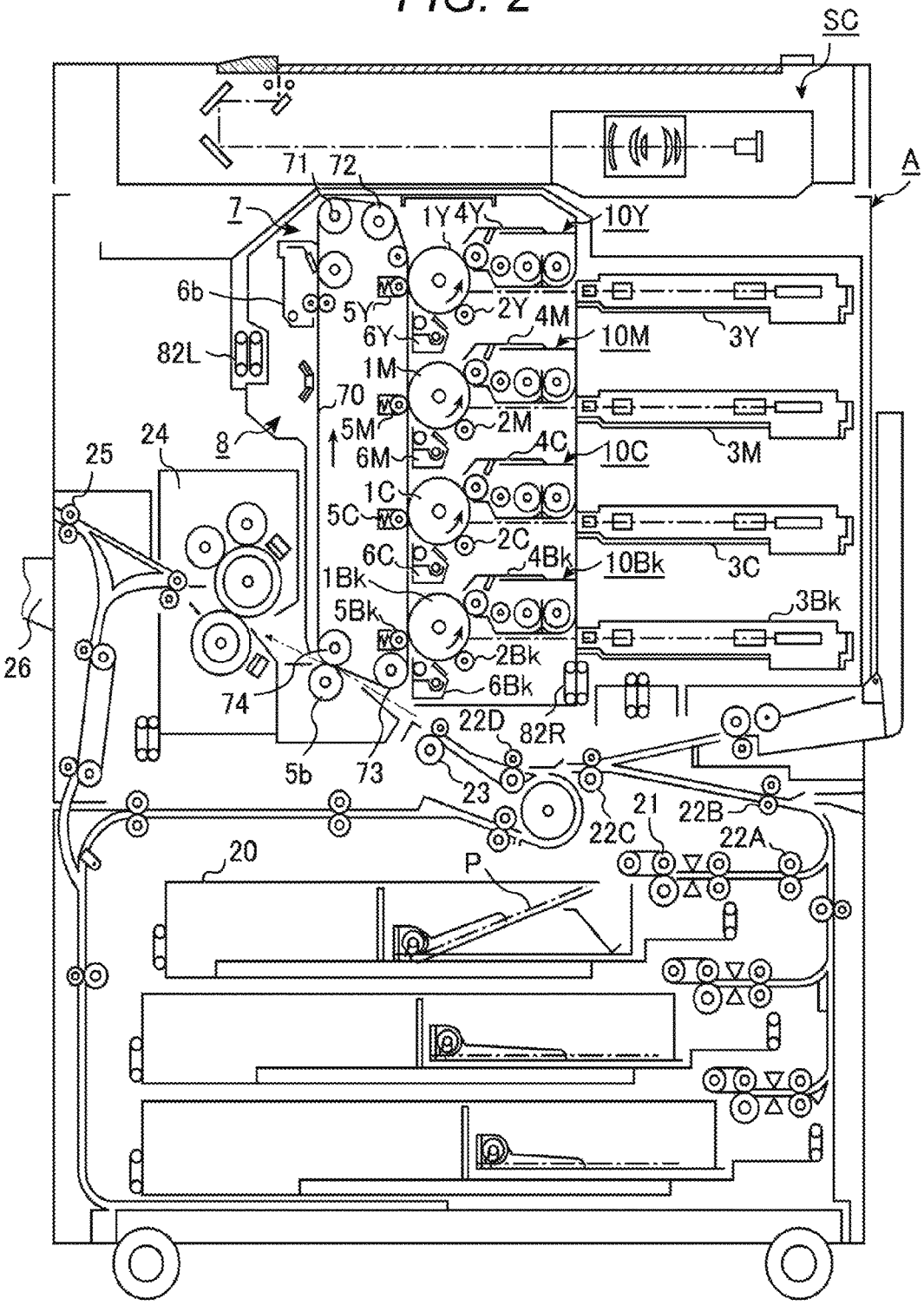
FIG. 2 is a schematic cross-sectional view illustrating an example of an image forming device using the photoreceptor according to an embodiment of the present invention.

FIG. 2 is an explanatory cross-sectional view illustrating a configuration of an example of an image forming device including the photoreceptor of an embodiment of the present invention.

This image forming device is referred to as a tandem type color image forming device and includes four sets of image forming units 10Y, 10M, 10C, and 10Bk, an intermediate transfer body unit 7, a paper feeding unit 21, and a fixing unit 24. An original image reading device SC is disposed above a main body A of the image forming device.

The four sets of image forming units 10Y, 10M, 10C, and 10Bk include charging units 2Y, 2M, 2C, and 2Bk, exposing units 3Y, 3M, 3C, and 3Bk, developing units 4Y, 4M, 4C, and 4Bk, a primary transfer unit including primary transfer rollers 5Y, 5M, 5C, and 5Bk, and cleaning units 6Y, 6M, 6C, and 6Bk for cleaning drum-shaped photoreceptors 1Y, 1M, 1C, and 1Bk, sequentially disposed around the photoreceptors 1Y, 1M, 1C, and 1Bk in a rotation direction of the photoreceptor 1Y.

In the image forming device of an embodiment of the present invention, the above photoreceptor of an embodiment of the present invention is used as each of the photoreceptors 1Y, 1M, 1C, and 1Bk.

The image forming units 10Y, 10M, 10C, and 10Bk have the same configuration with one another except that the colors of toner images formed on the photoreceptors 1Y, 1M, 1C, and 1Bk are different from one another, that is, the colors are yellow, magenta, cyan, and black. Hereinafter, the image forming unit 10Y will be described in detail as an example.

In the image forming unit 10Y, the charging unit 2Y, the exposing unit 3Y, the developing unit 4Y, the primary transfer roller 5Y, and the cleaning unit 6Y are disposed around the photoreceptor 1Y as an image forming body, and a yellow (Y) toner image is formed on the photoreceptor 1Y.

The charging unit 2Y gives a uniform potential to the photoreceptor 1Y.

The charging unit is not particularly limited and can use a known method. For example, a corona discharge type charger may be used, but a charging roller type is preferable.

As the charging roller type, a contact charging roller type or a non-contact charging roller type may be used. Note that the non-contact charging roller type is a method for obtaining a predetermined surface potential by AC and DC superimposed application by disposing a charging roller near an electrophotographic photoreceptor, having merits of both contact charging and non-contact charging.

The contact charging roller type or the non-contact charging roller type is preferable because environmental contamination such as generation of ozone does not occur, and furthermore, the charging roller is hardly contaminated Incidentally, usually, in a case of the contact charging roller type or the non-contact charging roller type, a problem arises due to decomposition of a lubricant. However, with the configuration of an embodiment of the present invention, good cleaning performance can be realized without a lubricant, and therefore this problem can be avoided.

Incidentally, in the example of FIG. 2, a contact charging roller type is adopted as the charging unit 2Y.

The exposing unit 3Y performs exposure on the photoreceptor 1Y to which a uniform potential has been given by the charging unit 2Y based on an image signal (yellow) to form an electrostatic latent image corresponding to the yellow image. As the exposing unit 3Y, a unit including an LED in which light emitting elements are arrayed in an axial direction of the photoreceptor 1Y and an image forming element, a laser optical system, or the like is used.

The developing unit 4Y includes, for example, a developing sleeve having a built-in magnet, holding a developer, and rotating, and a voltage applying device for applying a DC or AC bias voltage between the photoreceptor 1Y and the developing sleeve.

The primary transfer roller 5Y transfers a toner image formed on the photoreceptor 1Y onto an endless belt-shaped intermediate transfer body 70 and is disposed so as to be in contact with the intermediate transfer body 70.

The cleaning unit 6Y includes, for example, a cleaning blade and a brush roller disposed on an upstream side of the cleaning blade.

This image forming device includes, among the components of the image forming unit 10Y, the photoreceptor 1Y, the charging unit 2Y, the developing unit 4Y, and the cleaning unit 6Y integrally supported as a process cartridge. The process cartridge may be detachable from the device main body A via a guide unit such as a rail.

Examples of the fixing unit 24 include a heating roller fixing type including a heating roller with a heating source therein and a pressure roller disposed while being pressure-welded such that a fixing nip portion is formed on the heating roller.

The image forming units 10Y, 10M, 10C, and 10Bk are disposed vertically in cascade, and the intermediate transfer body unit 7 is disposed on the left side of the photoreceptors 1Y, 1M, 1C, and 1Bk in the drawing. The intermediate transfer body unit 7 includes the semiconductive endless belt-shaped intermediate transfer body 70 wound by a plurality of rollers 71, 72, 73, and 74 and rotatably supported, the primary transfer rollers 5Y, 5M, 5C, and 5Bk and the secondary transfer roller 5*b* disposed in the intermediate transfer body 70, and the cleaning unit 6*b*.

The image forming units 10Y, 10M, 10C, and 10Bk and the intermediate transfer body unit 7 are housed in a casing 8, and the casing 8 can be drawn from the device main body A via support rails 82L and 82R.

In the image forming device configured as described above, toner images are formed by the image forming units 10Y, 10M, 10C, and 10Bk. Specifically, first, surfaces of the photoreceptors 1Y, 1M, 1C, and 1Bk are negatively charged due to discharging by the charging units 2Y, 2M, 2C, and 2Bk. Subsequently, the surfaces of the photoreceptors 1Y, 1M, 1C, and 1Bk are exposed by the exposing units 3Y, 3M, 3C, and 3Bk based on image signals to form electrostatic latent images. Furthermore, a toner is supplied to the surfaces of the photoreceptors 1Y, 1M, 1C, and 1Bk by the developing units 4Y, 4M, 4C, and 4Bk, and the electrostatic latent images are developed to form toner images of the colors.

The toner images of the colors formed by the image forming units 10Y, 10M, 10C, and 10Bk are sequentially transferred and superimposed onto the intermediate transfer body 70 circulatedly moved by the primary transfer rollers 5Y, 5M, 5C, and 5Bk to form color toner images. Then, a transfer material (an image support for carrying a fixed final image: for example, plain paper or a transparent sheet) P housed in a paper feed cassette 20 is fed by a paper feeding unit 21, and is conveyed to the secondary transfer roller 5*b* via a plurality of intermediate rollers 22A, 22B, 22C, and 22D and a resist roller 23. Then, the secondary transfer roller 5*b* is brought into contact with the intermediate transfer body 70, and the color toner images are collectively transferred onto the transfer material P. Thereafter, the transfer material P onto which the color toner images have been transferred is separated at a portion having a high curvature of the intermediate transfer body 70, conveyed to the fixing unit 24, is fixed by the fixing unit 24, is nipped by a paper discharge roller 25, and is placed on a paper discharge tray 26 outside the machine Meanwhile, after the toner images of the colors are transferred onto the intermediate transfer body 70 by the primary transfer rollers 5Y, 5M, 5C, and 5Bk, in the photoreceptors 1Y, 1M, 1C, and 1Bk, a toner remaining thereon is removed by the cleaning units 6Y, 6M, 6C, and 6Bk.

After the color toner images are transferred onto the transfer material P by the secondary transfer roller 5*b*, in the intermediate transfer body 70 from which the transfer material P has been curvature-separated, a residual toner is removed by the cleaning unit 6*b*.

During the image forming treatment, the primary transfer roller 5Bk is in contact with the photoreceptor 1Bk all the time, and the other primary transfer rollers 5Y, 5M, and 5C are in contact with the corresponding photoreceptors 1Y, 1M, and 1C, respectively, only during formation of a color toner image.

The secondary transfer roller 5*b* is in contact with the intermediate transfer body 70 only when secondary transfer is performed.

Note that FIG. 2 illustrates the image forming device as a color laser printer, but the photoreceptor of an embodiment of the present invention can be similarly applied to a monoclonal laser printer or a copy machine. In this image forming device, a light source other than a laser, for example, an LED light source can be used as an exposure light source.

[Toner and Developer]

A toner used in the image forming device including the photoreceptor of an embodiment of the present invention may be a pulverization toner or a polymerization toner. However, in the image forming device according to an embodiment of the present invention, a polymerization toner manufactured by a polymerization method is preferably used from a viewpoint of obtaining a high-quality image.

The polymerization toner means a toner obtained by performing formation of a binder resin for forming a toner and formation of a toner particle shape in parallel by polymerization of a raw material monomer for obtaining the binder resin and, if necessary, a subsequent chemical treatment.

More specifically, the polymerization toner means a toner formed through a step of obtaining resin fine particles by a polymerization reaction such as suspension polymerization or emulsion polymerization, and a step of fusing resin fine particles performed thereafter, if necessary.

As a toner used in the image forming device including the photoreceptor of an embodiment of the present invention, it is preferable to use a toner containing a binder resin formed of a crystalline resin. By using a toner containing a binder resin formed of a crystalline resin, occurrence of fogging in an obtained image can be suppressed. It is considered that this is because variations in charging when a toner is frictionally charged in the developing units 4Y, 4M, 4C, and 4Bk are reduced.

The volume average particle diameter of a toner, that is, the 50% volume particle diameter (Dv 50) is desirably 2 to 9 μm, and more desirably 3 to 7 μm. By setting the volume average particle diameter in this range, it is possible to increase resolution. Furthermore, by combination with the above range, it is possible to reduce the abundance of a toner having a fine particle diameter even when the toner is a small particle diameter toner, to improve reproducibility of a dot image over a long period of time, and to form a stable image having good sharpness.

The toner according to an embodiment of the present invention may be used alone as a one-component developer, or may be mixed with a carrier to be used as a two-component developer.

In a case where the toner is used as a one-component developer, examples thereof include a nonmagnetic one-component developer and a magnetic one-component developer containing magnetic particles of about 0.1 to 0.5 μm in the toner, and both of these can be used.

In a case where the toner is mixed with a carrier to be used as a two-component developer, a conventionally known material, for example, a metal such as iron, ferrite, or magnetite, or alloys of these metals with a metal such as aluminum or lead can be used, and ferrite particles are particularly preferable. The magnetic particles have a volume average particle diameter preferably of 15 to 100 μm, more preferably of 25 to 80 μm.

The volume average particle diameter of the carrier can be typically measured with a laser diffraction type particle size distribution measurement apparatus "HELOS" (manufactured by SYMPATEC Gmbh) equipped with a wet type dispersing machine.

The carrier is preferably a carrier in which magnetic particles are further coated with a resin or a so-called resin dispersion type carrier in which magnetic particles are dispersed in a resin. The composition of a resin for coating is not particularly limited, but examples thereof include an olefin-based resin, a styrene-based resin, a styrene acrylic resin, a silicone-based resin, an ester-based resin, and a fluorine-containing polymer-based resin. As a resin for constituting the resin dispersion type carrier is not particularly limited, and a known resin can be used. Examples thereof include a styrene acrylic resin, a polyester resin, a fluorine-based resin, and a phenol resin.

Incidentally, an embodiment to which the present invention can be applied is not limited to the above-described embodiment and can be appropriately changed without departing from the gist of the present invention.

For example, the surface protective layer may contain various antioxidants and lubricant particles, if necessary, in addition to the above-described binder resin for a surface protective layer and conductive fine particles which have been subjected to specific fluorination surface modification.

[Example]

Hereinafter, the present invention will be specifically described with reference to Example, but the present invention is not limited thereto. Incidentally, expression "part" or "%" used in Example means "part by mass" or "% by mass" unless otherwise specified.

<<Manufacture of Photoreceptors 1 to 22>>

[Method for Manufacturing Photoreceptor 1]

<Synthesis of fluoroalkyl (meth)acrylate/(meth)acrylic Acid Copolymer A>

To a reaction vessel, 9.9 g of 2,2,3,3,4,4,4-heptafluorobutyl methacrylate, 0.1 g of acrylic acid, 0.3 g of a polymerization initiator "PEROIL SA" (manufactured by NOF CORPORATION), and 60.0 g of a fluorine-based solvent: methyl perfluorobutyl ether (manufactured by Tokyo Chemical Industry Co., Ltd.) were added and purged with dry nitrogen. The reaction vessel was sealed and heated at 70° C. for 24 hours under stirring. Thereafter, the reaction vessel was cooled and opened. Subsequently, the solution in the reaction vessel was poured into 300 mL of methanol. The obtained polymer was precipitated, and the precipitate was dried under vacuum to obtain a fluoroalkyl (meth)acrylate/(meth)acrylic acid copolymer A (hereinafter, also referred to as "fluorination surface modifier A") formed of a 2,2,3,3,4,4,4-heptafluorobutyl methacrylate/acrylic acid copolymer. Note that the fluorination surface modifier A is a specific fluorination surface modifier according to an embodiment of the present invention.

<Preparation of Conductive Fine Particles 1>

To 10 mL of methanol, 5 g of tin oxide (number average primary particle diameter=20 nm) was added and dispersed for 30 minutes using a US homogenizer. Subsequently, 0.35 g of a coupling agent: 3-methacryloxypropyltrimethoxysilane "KBM 503" (manufactured by Shin-Etsu Chemical Co., Ltd.) and 10 mL of toluene were added thereto, and the mixture was stirred at room temperature for one hour. Furthermore, the solvent was removed by an evaporator. Thereafter, heating was performed at 120° C. for one hour to obtain conductive fine particles a which had been subjected to surface modification with a coupling agent.

5.35 g of the obtained conductive fine particles a was added to 40 g of 2-butanol and dispersed for 60 minutes using a US homogenizer. Subsequently, 10 g of methyl perfluorobutyl ether was added thereto, and 0.15 g of the fluorination surface modifier A was further added. Furthermore, dispersion was performed using a US homogenizer for 60 minutes. Dispersion was performed while being confirmed by a particle size distribution meter. After dispersion, the solvent was volatilized at room temperature. The obtained powder was passed through sieves of 100 μm and 60 μm and dried at 80° C. for 60 minutes to prepare conductive fine particles 1 which had been subjected to specific fluorination surface modification.

<Manufacture of Photoreceptor 1>

(1) Manufacture of Conductive Support

A surface of a drum-shaped aluminum support (outer diameter 60 mm) was cut to manufacture a conductive support 1.

(2) Formation of Intermediate Layer

To 1700 parts by mass of a mixed solvent of ethanol/n-propyl alcohol/tetrahydrofuran (volume ratio 45/20/35), 100 parts by mass of a binder resin for an intermediate layer: polyamide resin "CM8000" (manufactured by Toray Industries, Inc.) was added, and the mixture was stirred and mixed at 20° C. To this solution, 120 parts by mass of titanium oxide particles "SMT500SAS" (manufactured by Tayca Corporation) and 160 parts by mass of titanium oxide particles "SMT150MK" (manufactured by Tayca Corporation) were added and dispersed by a bead mill with a mill residence time of 5 hours. Then, this solution was allowed to stand all day and night and then filtered to obtain a coating liquid for forming an intermediate layer. Filtration was performed under a pressure of 50 kPa using a rigid mesh filter (manufactured by Nihon Pall Ltd.) having a nominal filtration accuracy of 5 μm as a filtration filter. The coating liquid for forming an intermediate layer thus obtained was applied onto an outer peripheral surface of the cleaned conductive support 1 by a dip coating method and dried at 120° C. for 30 minutes to form an intermediate layer 1 having a thickness of 2 μm after drying.

(3) Formation of Charge Generating Layer

The following raw materials (a charge generating material, a binder resin for a charge generating layer, solvent 1, and solvent 2) were dispersed for 10 hours using a sand mill as a dispersing machine to prepare a coating solution 1 for forming a charge generating layer.

| | |
|---|---|
| Charge generating material: titanyl phthalocyanine pigment (having a maximum diffraction peak at least at a position of 27.3° in Cu-Kα characteristic X-ray diffraction spectrum measurement) | 20 parts by mass |
| Binder resin for charge generating layer: polyvinyl butyral resin "# 6000-C" (manufactured by Denka) | 10 parts by mass |
| Solvent 1: t-butyl acetate | 700 parts by mass |
| Solvent 2: 4-methoxy-4-methyl-2-pentanone | 300 parts by mass |

The coating solution 1 for forming a charge generating layer was applied onto the intermediate layer 1 by a dip coating method to form a coating film, thus forming a charge generating layer 1 having a layer thickness of 0.3 μm.

(4) Formation of Charge Transporting Layer

The following raw materials (a charge transporting material, a binder resin for a charge transporting layer, solvent 1, solvent 2, an antioxidant, and silicone oil) were mixed and dissolved to prepare a coating solution 1 for forming a charge transporting layer.

| | |
|---|---|
| Charge transporting material: 4,4'-dimethyl-4"-(β-phenylstyryl) triphenylamine) | 225 parts by mass |
| Binder resin for charge transporting layer: polycarbonate resin "Z300" (manufactured by Mitsubishi Gas Chemical Company, Inc.) | 300 parts by mass |
| Solvent 1: tetrahydrofuran (THF) | 1600 parts by mass |
| Solvent 2: toluene | 400 parts by mass |
| Butylated hydroxytoluene (BHT, antioxidant) | 6 parts by mass |
| Silicone oil "KF-96" (manufactured by Shin-Etsu Chemical Co., Ltd.) | 1 part by mass |

The coating solution 1 for forming a charge transporting layer was applied onto the charge generating layer 1 by a dip coating method to form a coating film, and the coating film was dried at 120° C. for 70 minutes to form a charge transporting layer 1 having a layer thickness of 20 μm.

(5) Formation of Surface Protective Layer 85 parts by mass of the above conductive fine particles 1, 100 parts by mass of an exemplified compound M1 as a radically polymerizable polyfunctional compound, 10 parts by mass of a melamine resin "Epostar S6" (average particle diameter: 400 nm, manufactured by Nippon Shokubai Co., Ltd.) as organic fine particles, 400 parts by mass of 2-butanol as a solvent, and 40 parts by mass of THF were mixed under light shielding and dispersed for five hours using a sand mill as a dispersing machine. Thereafter, as a polymerization initiator, 10 parts by mass of a compound represented by the following chemical structural formula (P) was added, stirred under light shielding, and dissolved to prepare a coating solution 1 for forming a surface protective layer.

This coating solution 1 for forming a surface protective layer was applied onto the charge transporting layer 1 using a circular slide hopper applicator to form a coating film. The formed coating film was irradiated with an ultraviolet ray for one minute using a metal halide lamp. As a result, a surface protective layer 1 having a thickness of 3.0 μm after drying was formed, thus manufacturing a photoreceptor 1.

[Chemical Formula 5]

M1

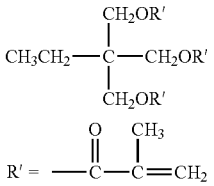

Chemical Structural Formula (P)

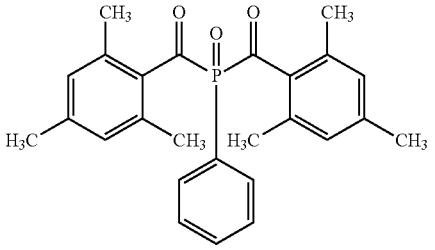

<Manufacture of Photoreceptor 2>

To 10 mL of methanol, 5 g of tin oxide (number average primary particle diameter=20 nm) was added and dispersed for 30 minutes using a US homogenizer. Subsequently, 10 g of methyl perfluorobutyl ether was added thereto, and 0.15 g of the fluorination surface modifier A was further added thereto. Furthermore, dispersion was performed for 60 minutes using a US homogenizer. Dispersion was performed while being confirmed by a particle size distribution meter. After dispersion, the solvent was volatilized at room temperature. The obtained powder was passed through sieves of 100 μm and 60 μm and dried at 80° C. for 60 minutes to prepare conductive fine particles 2 which had been subjected to specific fluorination surface modification. Note that the conductive fine particles 2 which had been subjected to specific fluorination surface modification had not been subjected to a coupling treatment.

85 parts by mass of the conductive fine particles 2 which had been subjected to specific fluorination surface modification and 100 parts by mass of a polycarbonate resin "Z300" (manufactured by Mitsubishi Gas Chemical Company, Inc.) were mixed with 400 parts by mass of 2-butanol and 40 parts by mass of THF as a solvent. The resulting mixture was stirred for five hours and dissolved using a sand mill as a dispersing machine to prepare a coating solution 2 for forming a surface protective layer. This coating solution 2 for forming a surface protective layer was applied onto the charge transporting layer 1 using a circular slide hopper applicator to form a coating film, thus forming a surface protective layer having a thickness of 8.0 μm after drying. A photoreceptor 2 was manufactured in a similar manner to the photoreceptor 1 except for the above.

<Manufacture of Photoreceptors 3 and 4>

A photoreceptor 3 was manufactured in a similar manner to the photoreceptor 1 except that a surface protective layer was formed using the conductive fine particles a in place of the conductive fine particles 1 and that the melamine resin "Epostar S6" which had been subjected to the following fluorine treatment was used as organic fine particles in the method for manufacturing the photoreceptor 1.

A photoreceptor 4 was manufactured in a similar manner to the photoreceptor 1 except that the melamine resin "Epostar S6" which had been subjected to the following fluorine treatment was used as organic fine particles in manufacturing the photoreceptor 1.

(Fluorine Treatment)

To 40 g of 2-butanol, 5 g of the melamine resin "Epostar S6" (average particle diameter: 400 nm, manufactured by Nippon Shokubai Co., Ltd.) was added and dispersed for 60 minutes using a US homogenizer. Subsequently, 10 g of methyl perfluorobutyl ether was added thereto, and 0.15 g of the fluorination surface modifier A was further added thereto. Furthermore, dispersion was performed for 60 minutes using a US homogenizer. Dispersion was performed while being confirmed by a particle size distribution meter. After dispersion, the solvent was volatilized at room temperature. The obtained powder was passed through sieves of 100 μm and 60 μm and dried at 80° C. for 60 minutes to prepare organic fine particles which had been subjected to specific fluorination surface modification.

<Manufacture of Photoreceptor 6>

A photoreceptor 6 was manufactured similarly except that the following conductive fine particles 3 were used in place of the conductive fine particles 1 in manufacture of the photoreceptor 1.

(Preparation of Conductive Fine Particles 3)

Figure 3:
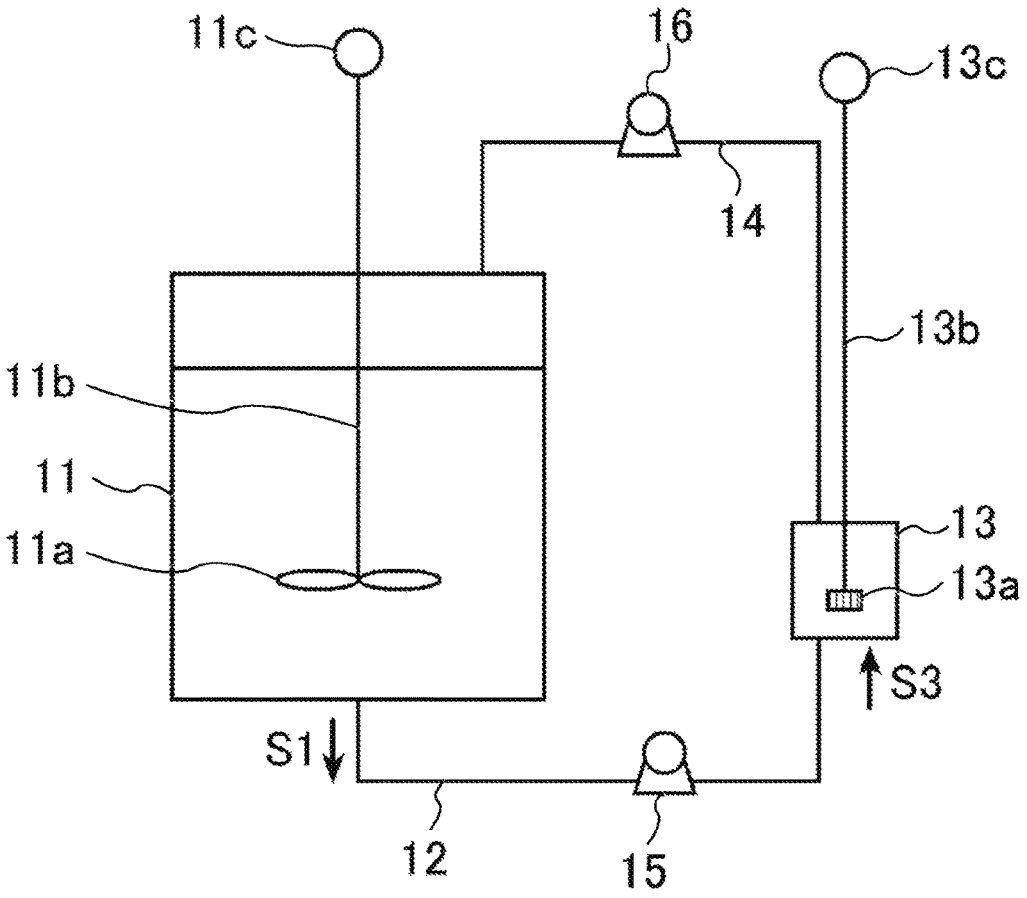
FIG. 3 is a schematic explanatory view illustrating a configuration of a device for manufacturing composite fine particles according to an embodiment of the present invention.

Using a manufacturing device illustrated in FIG. 3, the conductive fine particles 3 (composite fine particles) in which tin oxide (coating material) was attached to a surface of a barium sulfate core material were prepared.

Specifically, 3500 $cm^3$ of pure water was put in a mother liquid tank (11), then 900 g of a spherical barium sulfate core material having an average particle diameter D50 (described as "particle diameter" in Table I) of 50 nm was put therein, and circulation of 5 passes was performed. A flow rate of a slurry flowing out from the mother liquid tank (11) was 2280 $cm^3$/min. A stirring speed of a strong dispersion device (13) was 16000 rpm. After the circulation was completed, the slurry was made up to a total volume of 9000 $cm^3$ with pure water, 1,600 g of sodium stannate and 2.3 $cm^3$ of a sodium hydroxide aqueous solution (concentration: 25 mol/L) were put therein, and circulation of 5 passes was performed. In this way, a mother liquid was obtained. While this mother liquid was circulated such that a flow rate (S1) flowing out of the mother liquid tank (11) was 200 $cm^3$, 20% sulfuric acid was fed to a homogenizer "magic LAB" (manufactured by IKA Japan KK) as a strong dispersion device (13). A feeding rate (S3) was 9.2 $cm^3$/min. The homogenizer had a volume of 20 $cm^3$ and a stirring speed of 16000 rpm. Circulation was performed for 15 minutes, during which sulfuric acid was continuously fed to the homogenizer. In this way, particles having a coating layer of tin oxide formed on a surface of a barium sulfate core material were obtained.

The slurry containing the obtained particles was repulp-washed until conductivity thereof reached 600 μS/cm or less, and then Nutsche filtration was performed to obtain a cake. The cake was dried in air at 150° C. for 10 hours. Subsequently, the dried cake was pulverized, and the pulverized powder was subjected to reduction firing for 45 minutes at 450° C. in a 1 volume % $H_2/N_2$ atmosphere. As a result, the conductive fine particles 3 having tin oxide attached to the surface of a barium sulfate core material were obtained.

Here, in the manufacturing device illustrated in FIG. 3, reference numerals 12 and 14 denote circulation pipes forming a circulation path between the mother liquid tank 11 and the strong dispersion device 13, reference numerals 15 and 16 denote pumps disposed in the circulation pipes 12 and 14, reference numeral 11*a* denotes a stirring blade, a reference numeral 13*a* denotes a stirring part, reference numerals 11*b* and 13*b* denote shafts, and reference numerals 11*c* and 13*c* denote motors.

<Manufacture of Photoreceptors 7 to 22>

Photoreceptors 7 to 22 were manufactured by changing the kind and particle diameter of untreated conductive fine particles (or core material and coating material), the kind and addition amount of a coupling agent, and the kind and addition amount of organic fine particles based on Tables I and II in manufacture of the photoreceptor 1 or 6. Note that the photoreceptors 7 to 22 were manufactured in a similar manner to manufacture of the photoreceptor 1 except that the kind and addition amount of a fluorination surface modifier applied to conductive fine particles and organic fine particles were also changed to those illustrated in Tables I and II. Incidentally, in Table I, KBM503 indicates a coupling agent manufactured by Shin-Etsu Chemical Co., Ltd., and AKT877 indicate a titanium coupling agent manufactured by Gelest, Inc.

As an acrylic resin, "Epostar MX100W (average particle diameter: 150 nm, manufactured by Nippon Shokubai Co., Ltd.) was used.

In Tables I and II, the conductive fine particles of "none" in the fluorination surface modifier are fine particles which have not been subjected to fluorination surface modification.

Incidentally, in Table I, the conductive fine particles of "none" in the coating material are not composite fine particle but fine particles formed of a single conductive material. The conductive fine particles of "none" in the coupling agent are conductive fine particle which have not been subjected to surface modification with a coupling agent.

Table I describes the addition amount (parts by mass) in a case where the mass of the untreated conductive fine particles was 100 parts by mass as the addition amount of each of the coupling agent and the fluorination surface modifier.

In Table II, "none" in the organic fine particles means that organic fine particles are not added to a surface protective layer.

Table II describes the addition amount (parts by mass) in a case where the mass of the untreated crosslinkable organic fine particles was 100 parts by mass as the addition amount of the fluorination surface modifier.

Fluorination surface modifiers B and C (both are specific fluorination surface modifiers according to an embodiment of the present invention) were synthesized as follows. The following compound was used as a fluorination surface modifier D.

(Fluorination Surface Modifier B)

The fluorination surface modifier B formed of a 2,2,3,3-tetrafluoropropyl methacrylate/methacrylic acid copolymer was obtained similarly except that 2,2,3,3-tetrafluoropropyl methacrylate was used in place of 2,2,3,3,4,4,4-heptafluorobutyl methacrylate and that methacrylic acid was used in place of acrylic acid in the synthesis of the fluoroalkyl (meth)acrylate/(meth)acrylic acid copolymer A.

(Fluorination Surface Modifier C)

The specific fluorination surface modifier C formed of a 2,2,3,3,4,4,5,5,5-nonafluoropentyl methacrylate/acrylic acid copolymer was obtained similarly except that 2,2,3,3,4,4,5,5,5-nonafluoropentyl methacrylate was used in place of 2,2,3,3,4,4,4-heptafluorobutyl methacrylate in the synthesis of the fluoroalkyl (meth)acrylate/(meth)acrylic acid copolymer A.

(Fluorination Surface Modifier D)

The following compound was used as a fluorination surface modifier D.

[Chemical Formula 6]

Fluorination Surface Modifier D

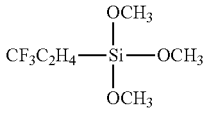

(Measurement of Number Average Primary Particle Diameter of Conductive Fine Particles)

Note that the number average primary particle diameter of the conductive fine particles used in the photoreceptors 1 to 22 was measured as follows.

First, as a measurement sample, a photosensitive layer including a surface protective layer was cut out from a surface of a photoreceptor with a knife or the like and pasted on an arbitrary holder such that the cut surface faced upward.

Then, the measurement sample was observed with a transmission electron microscope, and calculation was performed using a photographic image which had been taken. Specifically, a photograph was taken by setting the magnification of the microscope to 10000 times, 100 sample fine particles (conductive fine particles) were randomly extracted from the photographic image, and calculation was performed. That is, horizontal direction Feret diameters of 100 sample fine particles were measured by image analysis processing, and an average value thereof was calculated. This value was taken as the number average primary particle diameter. Note that the image analysis processing was automatically performed by driving a program incorporated in a transmission electron microscope measurement apparatus. In the present Example, a transmission electron microscope "JEM-2000FX" (manufactured by JEOL Ltd.) was used for measuring particle diameters of fine particles.

Note that the particle diameter of each conductive fine particle had a similar numerical value to that of "a core material or an untreated conductive fine particle" described in Table I.

TABLE I

| Photo-receptor No. | Conductive fine particles which have been subjected to specific surface modification: Untreated conductive fine particles: Coating material | Core material or untreated conductive fine particles: Kind | Particle diameter [nm] | Coupling agent: Kind | Coupling agent: Addition amount [part by mass] | Fluorination surface modifier: Kind | Fluorination surface modifier: Addition amount [part by mass] | Compound (or resin) constituting surface protective layer | Note |
|---|---|---|---|---|---|---|---|---|---|
| 1 | None | $SnO_2$ | 20 | KBM503 | 7 | A | 3 | Crosslinkable polymerizable compound | Example |
| 2 | None | $SnO_2$ | 20 | None | | A | 3 | Thermoplastic resin | Example |
| 3 | None | $SnO_2$ | 20 | KBM503 | 7 | None | | Crosslinkable polymerizable compound | Example |
| 4 | None | $SnO_2$ | 20 | KBM503 | 7 | A | 3 | Crosslinkable polymerizable compound | Example |
| 5 | None | $SnO_2$ | 50 | KBM503 | 7 | A | 3 | Crosslinkable polymerizable compound | Example |
| 6 | $SnO_2$ | $BaSO_4$ | 50 | KBM503 | 7 | A | 3 | Crosslinkable polymerizable compound | Example |
| 7 | $SnO_2$ | $BaSO_4$ | 100 | KBM503 | 3 | A | 3 | Crosslinkable polymerizable compound | Example |
| 8 | None | $SnO_2$ | 20 | AKT877 | 8 | B | 1 | Crosslinkable polymerizable compound | Example |
| 9 | $SnO_2$ | $BaSO_4$ | 100 | AKT877 | 2 | C | 10 | Crosslinkable polymerizable compound | Example |
| 10 | None | $TiO_2$ | 30 | KBM503 | 7 | A | 3 | Crosslinkable polymerizable compound | Example |
| 11 | $SnO_2$ | $BaSO_4$ | 300 | KBM503 | 3 | B | 5 | Crosslinkable polymerizable compound | Example |
| 12 | $SnO_2$ | $BaSO_4$ | 500 | KBM503 | 3 | B | 5 | Crosslinkable polymerizable compound | Example |
| 13 | None | $TiO_2$ | 15 | AKT877 | 8 | A | 1 | Crosslinkable polymerizable compound | Example |
| 14 | $CuAl_2O_3$ | $BaSO_4$ | 50 | KBM503 | 3 | C | 5 | Crosslinkable polymerizable compound | Example |
| 15 | None | $SnO_2$ | 20 | None | | A | 3 | Crosslinkable polymerizable compound | Example |
| 16 | None | $SnO_2$ | 20 | KBM503 | 7 | A | 3 | Crosslinkable polymerizable compound | Example |
| 17 | $SnO_2$ | $BaSO_4$ | 100 | None | | None | | Crosslinkable polymerizable compound | Comparative Example |
| 18 | $SnO_2$ | $BaSO_4$ | 100 | KBM503 | 7 | None | | Crosslinkable polymerizable compound | Comparative Example |
| 19 | None | $SnO_2$ | 20 | KBM503 | 7 | A | 3 | Crosslinkable polymerizable compound | Comparative Example |
| 20 | $SnO_2$ | $BaSO_4$ | 100 | None | | None | | Crosslinkable polymerizable compound | Comparative Example |
| 21 | $SnO_2$ | $BaSO_4$ | 100 | KBM503 | 7 | None | | Crosslinkable polymerizable compound | Comparative Example |
| 22 | None | $SnO_2$ | 20 | KBM503 | 7 | D | 3 | Crosslinkable polymerizable compound | Comparative Example |

TABLE II

| Photo-receptor No. | Organic fine particles: Untreated crosslinkable organic fine particles: Kind | Untreated crosslinkable organic fine particles: Addition amount [part by mass] | Fluorination surface modifier: Kind | Fluorination surface modifier: Addition amount [part by mass] | Note |
|---|---|---|---|---|---|
| 1 | Melamine resin | 10 | None | | Example |
| 2 | Melamine resin | 10 | None | | Example |
| 3 | Melamine resin | 10 | A | 3 | Example |
| 4 | Melamine resin | 10 | A | 3 | Example |
| 5 | Melamine resin | 10 | None | | Example |
| 6 | Melamine resin | 10 | None | | Example |
| 7 | Melamine resin | 10 | None | | Example |
| 8 | Melamine resin | 10 | None | | Example |
| 9 | Melamine resin | 10 | None | | Example |

TABLE II-continued

| Photo-receptor No. | Organic fine particles: Untreated crosslinkable organic fine particles: Kind | Untreated crosslinkable organic fine particles: Addition amount [part by mass] | Fluorination surface modifier: Kind | Fluorination surface modifier: Addition amount [part by mass] | Note |
|---|---|---|---|---|---|
| 10 | Melamine resin | 10 | None | | Example |
| 11 | Melamine resin | 10 | None | | Example |
| 12 | Melamine resin | 10 | None | | Example |
| 13 | Melamine resin | 10 | None | | Example |
| 14 | Melamine resin | 10 | None | | Example |
| 15 | Melamine resin | 10 | None | | Example |
| 16 | Melamine resin | 10 | None | | Example |
| 17 | Melamine resin | 10 | None | | Comparative Example |

TABLE II-continued

| Photoreceptor No. | Organic fine particles: Untreated crosslinkable organic fine particles: Kind | Addition amount [part by mass] | Fluorination surface modifier: Kind | Addition amount [part by mass] | Note |
|---|---|---|---|---|---|
| 18 | Melamine resin | 10 | None | | Comparative Example |
| 19 | | None | | | Comparative Example |
| 20 | | None | | | Comparative Example |
| 21 | | None | | | Comparative Example |
| 22 | Melamine resin | 10 | None | | Comparative Example |

[Evaluation Method]

The photoreceptors 1 to 22 were evaluated as follows. Results are illustrated in Table III.

<Evaluation of Cleaning Performance>

Evaluation machine: bizhub C658 (manufactured by Konica Minolta, Inc.)

A black toner was used as a developer, and the addition amount of a lubricant used for usual printing (for example, zinc stearate "ZnSt" manufactured by NOF CORPORATION) was 0.

Print image: 5% printing chart

Each of the photoreceptors 1 to 22 was mounted as a photoreceptor (corresponding to 1Bk in FIG. 2) in an image unit for black in an NN environment (23° C. 50% RH), and a long-term printing test of 5000 sheets of printing was performed with a predetermined print image (5% printing chart).

After long-term printing, a surface of each of the photoreceptors was observed with a microscope, and the number of deposits derived from the developer in a field of view of 20 mm×40 mm was measured.

(Evaluation Criteria)

○: 5 or less deposits (acceptable: excellent)

Δ: more than 5 deposits and 10 or less deposits (acceptable: no practical problem)

x: 11 or more deposits (unacceptable: practically problematic)

<Evaluation of Electrical Characteristics>

Evaluation machine: bizhub C658 (manufactured by Konica Minolta, Inc.)

Each of the photoreceptors 1 to 22 was mounted as a photoreceptor (corresponding to 1Bk in FIG. 2) in an image unit for black in an NN environment (23° C. 50% RH). A surface potential of the photoreceptor was set to 600±30 V when a white solid image was formed. A surface potential of the photoreceptor at a developing position was measured when a black solid image was formed.

(Evaluation Criteria)

○: A surface potential of a photoreceptor is less than 80 V (acceptable)

x: A surface potential of a photoreceptor is 80 V or more (unacceptable)

TABLE III

| Photoreceptor No. | Evaluation result: Cleaning performance: Deposit [number] | Judgement | Electrical characteristics: Vi [V] | Judgement | Note |
|---|---|---|---|---|---|
| 1 | 3 | ○ | 60 | ○ | Example |
| 2 | 5 | ○ | 40 | ○ | Example |
| 3 | 5 | ○ | 70 | ○ | Example |
| 4 | 3 | ○ | 55 | ○ | Example |
| 5 | 5 | ○ | 62 | ○ | Example |
| 6 | 4 | ○ | 58 | ○ | Example |
| 7 | 4 | ○ | 70 | ○ | Example |
| 8 | 4 | ○ | 76 | ○ | Example |
| 9 | 5 | ○ | 65 | ○ | Example |
| 10 | 5 | ○ | 75 | ○ | Example |
| 11 | 5 | ○ | 65 | ○ | Example |
| 12 | 5 | ○ | 75 | ○ | Example |
| 13 | 4 | ○ | 60 | ○ | Example |
| 14 | 3 | ○ | 55 | ○ | Example |
| 15 | 4 | ○ | 67 | ○ | Example |
| 16 | 3 | ○ | 75 | ○ | Example |
| 17 | 23 | X | 121 | X | Comparative Example |
| 18 | 25 | X | 132 | X | Comparative Example |
| 19 | 38 | X | 78 | ○ | Comparative Example |
| 20 | 34 | X | 72 | ○ | Comparative Example |
| 21 | 42 | X | 74 | ○ | Comparative Example |
| 22 | 20 | X | 110 | X | Comparative Example |

(Conclusion)

As is apparent from the above results, according to an embodiment of the present invention, even in a case where long-term printing of 5000 sheets is performed without a lubricant, an electrophotographic photoreceptor or the like having better electrical characteristics and cleaning performance can be provided.

According to an embodiment of the present invention, it is possible to provide an electrophotographic photoreceptor or the like capable of improving electrical characteristics and cleaning performance even if the supply amount of a lubricant is small.

An exhibition mechanism or an action mechanism of an effect of an embodiment of the present invention has not been clarified but is considered as follows.

By adding conductive fine particles and crosslinkable organic fine particles having high mechanical strength to a surface protective layer of a photoreceptor, mechanical strength of a surface of the photoreceptor can be increased. As a result, even if printing is performed for a long period of time, wear and tear of the photoreceptor can be suppressed, and the life of the photoreceptor can be prolonged.

Furthermore, it has been found that a driving torque of the photoreceptor is stabilized and that cleaning performance is improved by inclusion of the crosslinkable organic fine particles in the surface protective layer. A mechanism by which the torque is stabilized is not clearly understood. However, it is considered this is because the surface protective layer has a sea-island structure contributing to stabilizing torque. A curable resin component as the sea has high torque and is unstable. However, crosslinkable organic fine particles as the island have low torque. Therefore, it is considered that the sea-island structure as a whole can lower the torque. As a result, introduction of a cleaning blade edge into a rotational direction can be suppressed at the time of rotation of the photoreceptor. Therefore, it is considered that this acts for stabilizing torque.

Incidentally, conventionally, when conductive fine particles and crosslinkable organic fine particles are dispersed in a coating liquid for forming a surface protective layer, there has been a concern that the conductive fine particles and the crosslinkable organic fine particles aggregate.

However, the present inventor has found that by subjecting surfaces of at least one of the conductive fine particles and the crosslinkable organic fine particles having a melamine structure to surface modification with a surface modifier having a fluoroalkyl group (that is, a fluoroalkyl (meth)acrylate/(meth)acrylic acid copolymer), surface energies and charging states of two kinds of fine particles, that is, the conductive fine particles and the crosslinkable organic fine particles, are changed, and aggregation of the two kinds of fine particles can be suppressed.

Furthermore, the present inventor has found that by suppressing aggregation of the two kinds of fine particles upon dispersing, it is possible to increase light transmittance of the surface protective layer, to maintain sensitivity of the photoreceptor well, and to suppress cleaning failure caused by aggregation of the fine particles in the surface protective layer.

In this way, in the present invention, by subjecting at least one of the conductive fine particles and the crosslinkable organic fine particles having a melamine structure to surface modification with a surface modifier having a fluoroalkyl (meth)acrylate/(meth)acrylic acid copolymer and adding two kinds of fine particles to the surface layer of the photoreceptor, mechanical strength of the photosensitive layer is improved, the amount of depletion of the photoreceptor is suppressed, and cleaning performance is improved by improving a surface quality of the photosensitive layer. In addition, dispersibility in preparing a coating dispersion is improved, and cleaning performance and electrical characteristics due to aggregated fine particles are improved.

Incidentally, as a method for subjecting surfaces of the conductive fine particles to a fluorine treatment, a technique is known in which surface modification is performed with a silane coupling agent containing a fluorine atom, for example, disclosed in JP 6-258857 A. However, this method exhibits an insufficient effect due to a small surface area of molecules to be subjected to a fluorine treatment. As in the present invention, by using a fluoroalkyl (meth)acrylate/(meth)acrylic acid copolymer in place of a silane coupling agent containing a fluorine atom, in a case where the surface area of a molecule is large, a surface state of the conductive fine particles can be changed more effectively. As a result, the effect of the present invention can be exhibited.

Incidentally, in techniques described in JP 2011-197443 A, JP 2011-128546 A, JP 2009-53727 A, and JP 2016-164625 A, the crosslinkable organic fine particles according to an embodiment of the present invention are not included.

In addition, in a technique described in JP 2015-114453 A, neither conductive fine particles nor crosslinkable organic fine particles have not been subjected to surface modification with a fluoroalkyl (meth)acrylate/(meth)acrylic acid copolymer.

Although embodiments of the present invention have been described and illustrated in detail, the disclosed embodiments are made for purposes of illustration and example only and not limitation. The scope of the present invention should be interpreted by terms of the appended claims.

What is claimed is:

1. An electrophotographic photoreceptor obtained by laminating a photosensitive layer and a surface protective layer in this order on a conductive support, wherein the surface protective layer contains conductive fine particles and crosslinkable organic fine particles, either the conductive fine particles or the crosslinkable organic fine particles have been subjected to surface modification with a fluoroalkyl (meth)acrylate/(meth)acrylic acid copolymer, and the fluoroalkyl (meth)acrylate/(meth)acrylic acid copolymer has both a structural unit represented by the following general formula (1a) and a structural unit represented by the following general formula (1b):

General Formula (1a)

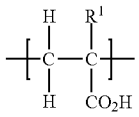

General Formula (1b)

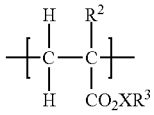

wherein, $R^1$ represents a hydrogen atom or a methyl group, $R^2$ represents a linear or branched alkyl group having 1 to 4 carbon atoms, X represents an alkylene group having 1 to 4 carbon atoms, and $R^3$ represents a perfluoroalkyl group having 1 to 5 carbon atoms.

2. The electrophotographic photoreceptor according to claim 1, wherein the crosslinkable organic fine particles contain a compound having a melamine structure.

3. The electrophotographic photoreceptor according to claim 1, wherein the conductive fine particles have a number average primary particle diameter in a range of 10 to 500 nm.

4. The electrophotographic photoreceptor according to claim 1, wherein the conductive fine particles have been subjected to surface modification with a compound having an acryloyl group or a methacryloyl group and the fluoroalkyl (meth)acrylate/(meth)acrylic acid copolymer.

5. The electrophotographic photoreceptor according to claim 1, wherein the conductive fine particles contain any one of titanium oxide, tin oxide, and copper aluminate.

6. The electrophotographic photoreceptor according to claim 1, wherein the surface protective layer contains a binder resin, and the binder resin is a curable resin obtained by polymerizing a crosslinkable polymerizable compound having an acryloyl group or a methacryloyl group.

7. The electrophotographic photoreceptor according to claim 1, wherein the conductive fine particles are composite fine particles obtained by attaching conductive metal oxide to a surface of a core material.

8. An electrophotographic image forming device comprising:

a charging roller; and the electrophotographic photoreceptor according to claim 1.

9. An electrophotographic photoreceptor obtained by laminating a photosensitive layer and a surface protective layer in this order on a conductive support, wherein the surface protective layer contains conductive fine particles and crosslinkable organic fine particles, either the conductive fine particles or the crosslinkable organic fine particles have been subjected to surface modification with a fluoroalkyl (meth)acrylate/(meth) acrylic acid copolymer, and the surface protective layer further contains a binder resin, and the binder resin is a curable resin obtained by polymerizing a crosslinkable polymerizable compound having an acryloyl group or a methacryloyl group.

10. An electrophotographic image forming device comprising:

a charging roller; and the electrophotographic photoreceptor according to claim 9.

11. An electrophotographic photoreceptor obtained by laminating a photosensitive layer and a surface protective layer in this order on a conductive support, wherein the surface protective layer contains conductive fine particles and crosslinkable organic fine particles, either the conductive fine particles or the crosslinkable organic fine particles have been subjected to surface modification with a fluoroalkyl (meth)acrylate/(meth) acrylic acid copolymer, and the conductive fine particles are composite fine particles obtained by attaching conductive metal oxide to a surface of a core material.

12. An electrophotographic image forming device comprising:

a charging roller; and the electrophotographic photoreceptor according to claim 11.

* * * * *